US005435669A

United States Patent [19]

Weber

[11] Patent Number: 5,435,669

[45] Date of Patent: Jul. 25, 1995

[54] LAGGIN MEMBERS FOR EXCAVATION SUPPORT AND RETAINING WALLS

[75] Inventor: Paul R. Weber, Seattle, Wash.

[73] Assignee: Don Morin, Inc., Auburn, Wash.

[21] Appl. No.: 943,778

[22] Filed: Sep. 11, 1992

[51] Int. Cl.[6] ..... E02D 29/02

[52] U.S. Cl. ..... 405/284; 405/285; 52/604; 52/608; 428/34.1

[58] Field of Search ..... 405/272, 283, 273, 282, 405/284, 285; 52/169.1, 169.2, 604, 606, 607, 608, 309.15, 309.17; 47/83; 256/19; 428/33, 34.1

[56] References Cited

U.S. PATENT DOCUMENTS

| | | | |
|---|---|---|---|
| 1,277,829 | 9/1918 | Baum | 52/607 |
| 1,933,483 | 10/1933 | Pennoyer | 405/285 |
| 1,996,774 | 4/1935 | Powers | 405/273 |
| 3,350,275 | 10/1967 | Hourigan et al. | 52/309.15 X |
| 3,830,687 | 8/1974 | Re et al. | 52/309.15 X |
| 4,096,676 | 6/1978 | Herbert | 52/309.15 X |
| 4,259,029 | 3/1981 | Koehl | 405/282 |
| 4,285,179 | 8/1981 | Goidinger | 52/606 X |
| 4,303,707 | 12/1981 | Prior | 52/309.154 |
| 4,369,004 | 1/1983 | Weatherby | 405/262 |
| 4,407,612 | 9/1983 | van Weele | 405/285 |
| 4,448,571 | 5/1984 | Eckels | 405/284 |
| 4,530,622 | 7/1985 | Mercer | 405/258 |
| 4,557,634 | 12/1985 | Vidal | 405/286 |
| 4,661,023 | 4/1987 | Hilfiker | 405/284 X |
| 4,671,706 | 6/1987 | Giardini | 52/608 X |
| 4,681,302 | 7/1987 | Thompson | 256/13.1 |
| 4,690,588 | 1/1987 | Berger | 405/262 |
| 4,728,227 | 3/1988 | Wilson et al. | 405/284 |
| 4,804,299 | 2/1989 | Forte et al. | 405/285 |
| 4,863,315 | 9/1989 | Wickberg | 405/278 |
| 4,910,280 | 3/1990 | Robbins | 428/33 X |
| 4,917,543 | 4/1990 | Cole et al. | 405/262 |
| 4,965,097 | 10/1990 | Bach | 428/194 |
| 5,044,834 | 9/1991 | Janopaul, Jr. | 405/284 |

FOREIGN PATENT DOCUMENTS

| | | | |
|---|---|---|---|
| 2527746 | 1/1977 | Germany | 52/604 |

OTHER PUBLICATIONS

Copy of ROTO TECH Industries, a Division of Oregon Coast Sanitation, Inc. Brochure for Heavy-Duty Multi--Purpose Tanks Lightweight Polyethylene, 6 pp.

Copy of NW & Alaska Collins Company Brochure for ShoreGuard TM Rigid Vinyl Sheet Piling and Re-cycled Plastic Round Piling Lumber/Timber Piling Tape, 5 pp.

*Primary Examiner*—Randolph A. Reese
*Assistant Examiner*—John Ricci
*Attorney, Agent, or Firm*—Christensen, O'Connor, Johnson & Kindness

[57] ABSTRACT

A soil retention wall system 10 includes a plurality of vertical piles 12 placed in spaced succession. A plurality of hollow polymeric lagging members 14 are stacked transversely relative to, and spanning between, successive piles to form the wall. Each lagging member is formed from a shell having a major wall 106 defining top and bottom surfaces 28 and 30, and first and second endwalls 36 and 38 each adapted to be engagable with an adjacent pile. In a preferred embodiment, the shell 24 is of unitary, one-piece construction.

11 Claims, 16 Drawing Sheets

LAGGIN MEMBERS FOR EXCAVATION SUPPORT AND RETAINING WALLS

FIELD OF THE INVENTION

The present invention relates to soil retention walls, particularly to excavation support and retaining walls.

BACKGROUND OF THE INVENTION

The construction and landscaping trades often require the installation of soil retaining walls for temporary excavation support, as permanent subsurface walls, and as permanent above-ground retaining walls. Such soil support walls are conventionally constructed from elongate beams, referred to as lagging, that are stacked in horizontal disposition to form a vertical or inclined wall. The stacked beams are often supported by vertical soldier piles. Tie-back anchors may also be utilized to support the stacked beams, whereby deadman elements are buried in the soil behind the wall and tied to the wall by an elongate cable or rod.

Lagging members for soil support walls are typically either timbers or are formed from reinforced concrete. In the case of wooden timbers, the lagging is heavy and labor intensive to install. The configuration of the beams is limited, and any passages within the beams for the placement of drains, reinforcing members, or electrical wiring must be formed by cutting or drilling, which is also labor intensive and therefore expensive. Such cutting reduces the structural integrity and therefore is typically avoided. Additionally, the shape of the timbers is essentially limited to rectangular planks or cylinders, given the nature of the material.

In the case of preformed concrete lagging, the lagging members are also very heavy and therefore require labor and machinery intensive placement. Although a wide variety of shapes and configurations of lagging can be precast, once cast it is difficult to adapt, requiring abrasive cutting and drilling. Alternately, concrete lagging can be cast in place, but the requirement for the provision and placement of forms is also labor intensive and costly.

Construction of temporary excavation support walls often occurs under adverse conditions, with loose soil and mud being present. The weight of conventional timbers or concrete lagging all too often results in slippage and injury of construction workers, particularly under such adverse conditions.

SUMMARY OF THE INVENTION

The present invention provides a hollow polymeric lagging member for soil support walls. The lagging member is formed from a one-piece shell including a major wall defining opposing first and second stacking surfaces, and first and second integral endwalls. The major wall and endwalls define and enclose the internal cavity of the lagging member. In a preferred embodiment, the hollow polymeric lagging member is a rotary molding having major wall and endwalls of substantially uniform thickness.

In a further aspect of the present invention, a soil retention wall system is provided that includes a plurality of piles emplaceable in spaced succession. The retention wall system also includes a plurality of hollow polymeric lagging members. Each lagging member has a major wall defining top and bottom surfaces, and first and second endwalls each adapted to be engagable with a pile when the lagging members are stacked transversely relative to, and spanning between, successive piles, thereby forming a soil retention wall.

The hollow polymeric lagging members of the present invention can be configured in a wide variety of structural shapes, depending upon the application. For example, the lagging members can include ribs for strength, apertures to enable filling with cementious material, sand or plastic foam after placement, and internal and external channels that are preformed in order to receive drains, grout, reinforcing members, or for other purposes.

The lagging members of the present invention are lightweight and therefore require less labor for placement than conventional members. As a result of the reduced weight, the likelihood of injury to construction workers is reduced. The lagging members are easily adapted, if necessary, upon installation because they are easily drilled, heat-welded, nailed, bolted, or riveted. They can also be filled with concrete, sand or plastic foam after placement, thus serving as permanent, integral forms. The polymeric lagging members are notably environmentally resistant and recyclable.

A significant advantage of the hollow polymeric lagging of the present invention is the opportunity provided thereby for post-construction structural improvement and modification of soil retention walls constructed in accordance with the present invention. For example, a soil retention wall can be designed and constructed to withstand an anticipated soil load using hollow, unfilled polymeric lagging members. If the soil load increases after construction of the wall, such as when buildings are constructed on the earth above the wall, the lagging members can be easily reinforced to increase the wall's load bearing capacity without requiring disassembly of the wall. This is done by drilling into the members, and then introducing grout or other reinforcing material. Likewise, if voids in the soil develop behind the wall during or after construction, grout can be pumped behind the walls through access channels or passages formed in the lagging, as shall be described hereinbelow, to fill the void.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
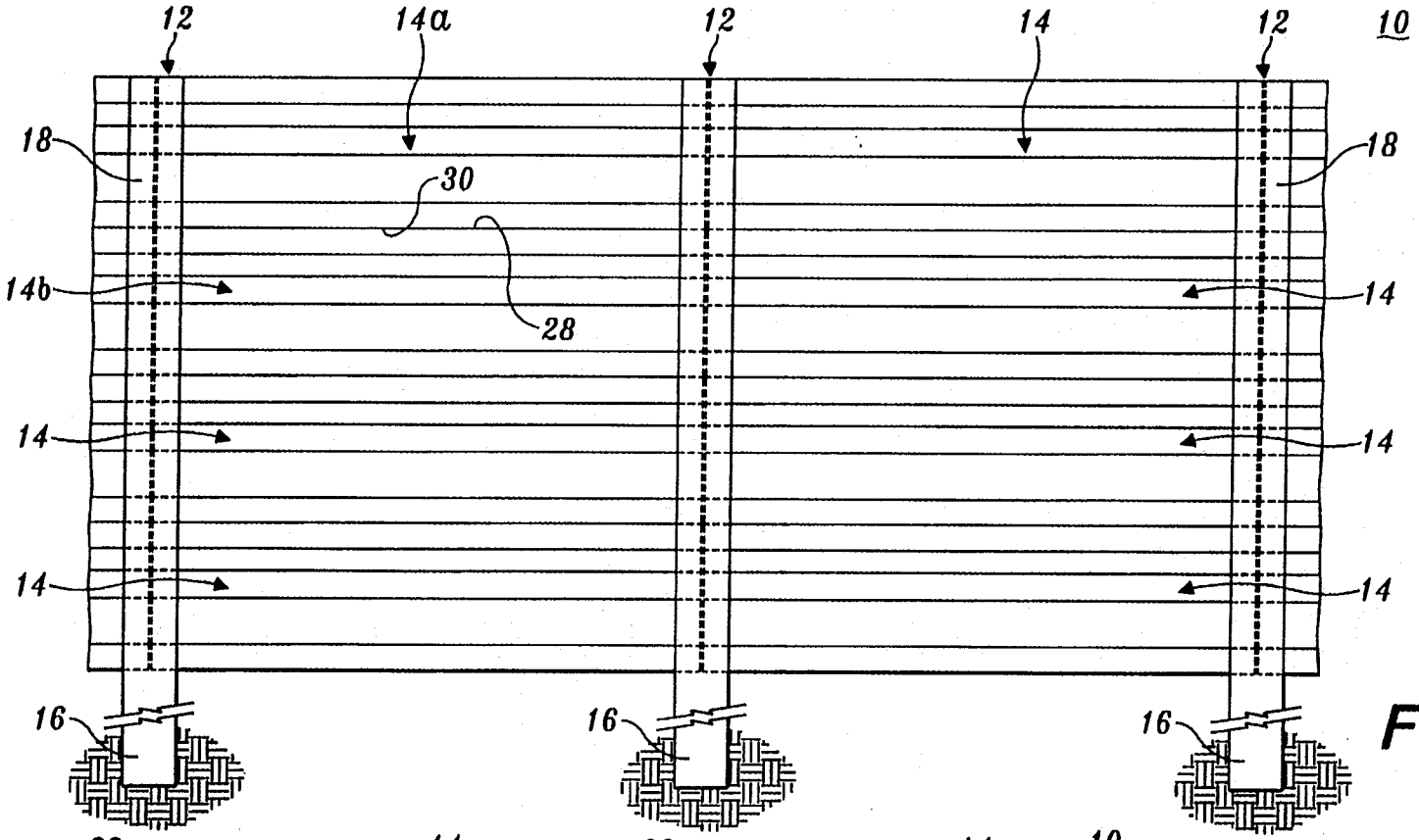
FIG. 1 shows a front view of a soil retention wall constructed in accordance with the present invention.

A soil retention wall 10 constructed in accordance with the present invention is shown in FIG. 1. The wall is constructed from a plurality of soldier piles 12 that are placed in spaced succession. A plurality of hollow polymeric lagging members 14 are stacked transversely relative to, and spanning between, the successive piles 12, thereby forming a solid shield behind which earth may be retained.

As used herein throughout, the term "soil retention wall" is used to refer to any wall or barrier for supporting soil, fill, or other loose materials, including temporary excavation supports, permanent retaining walls, permanent subsurface walls, erosion or slope protection walls, and track or arena walls. The wall 10 can be oriented either vertically or can be inclined on a slope.

The term "lagging members" is used herein throughout to refer to structural members, typically elongate, that can be stacked together as components of soil retention walls. Most often the lagging members are disposed horizontally and stacked between vertical soldier piles to form vertical walls. However, it is to be understood that the lagging members can also be disposed vertically and placed side-by-side to form a wall, as may be required in some applications.

Figure 2:
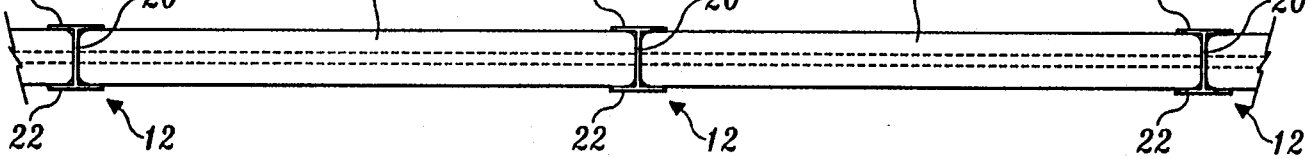
FIG. 2 shows a top view of the soil retention wall of FIG. 1.

In the preferred embodiment of FIGS. 1 and 2, the stacked lagging members 14 are stabilized and interconnected by the soldier piles 12. Each soldier pile 12 has a lower portion 16 embedded in the soil and an upwardly projecting portion 18 for engagement with the lagging members 14. The soldier piles 12 are preferably oriented either vertically or on an incline, depending on the application. The soldier piles 12 are spaced at even intervals approximately equal to the length of the lagging members 14, and are oriented parallel to each other.

In the first preferred embodiment, each soldier pile 12 consists of a structural steel H-section beam. The soldier piles 12 are placed with their central web sections 20 oriented parallel to each other. The installed lagging members 14 span between and abut the central web sections 20 of adjacent soldier piles 12. Each end of each lagging member 14 is received between, and constrained by, the surface flanges 22 of the corresponding soldier pile 12. Loads transmitted by soil placed behind the lagging members 14 is thus transmitted to the soldier piles 12.

It should be readily apparent to those of skill in the art that although "H"-section beams have been illustrated for use as soldier piles 12, other pile configurations, such as wooden beams or cylindrical poles, could be utilized. In that case, the ends of the lagging members 14 are disposed behind the two adjacent soldier piles 12, and are retained in this position by soil placed behind the lagging members 14.

Figure 3:
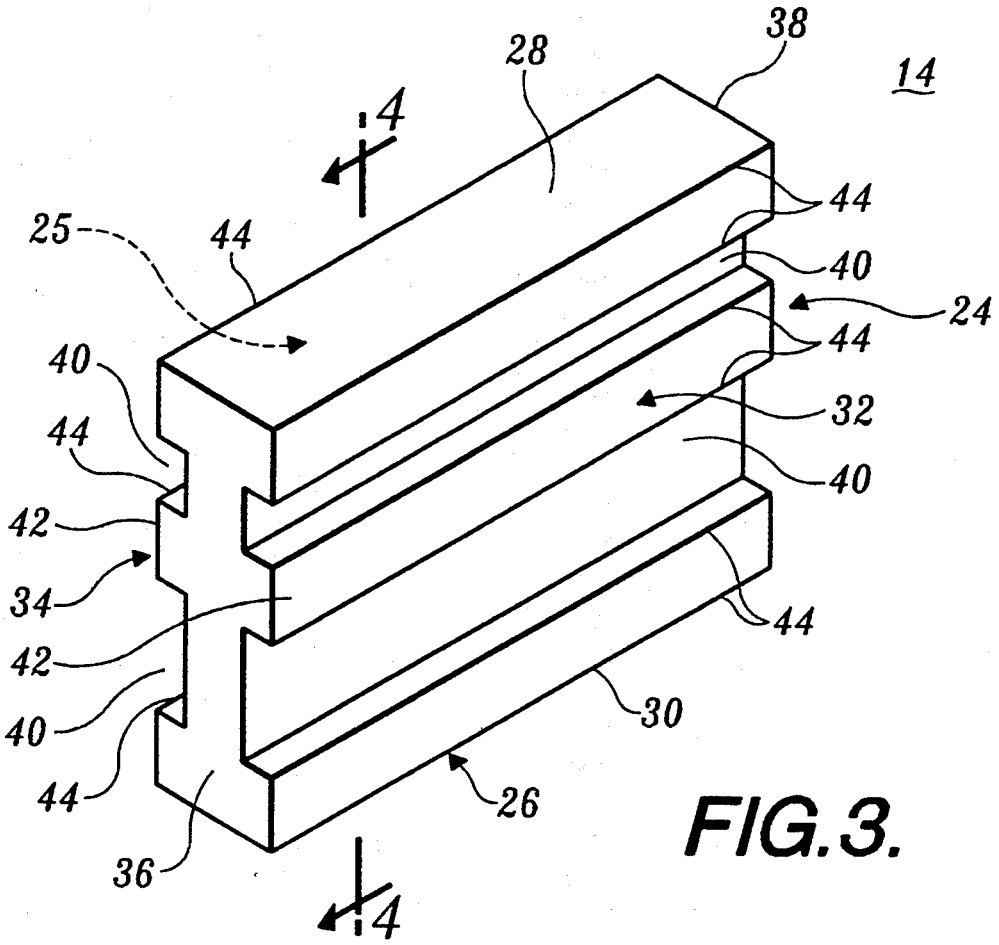
FIG. 3 shows a pictorial view of a polymeric lagging member used in the wall of FIG. 1.
Figure 4:
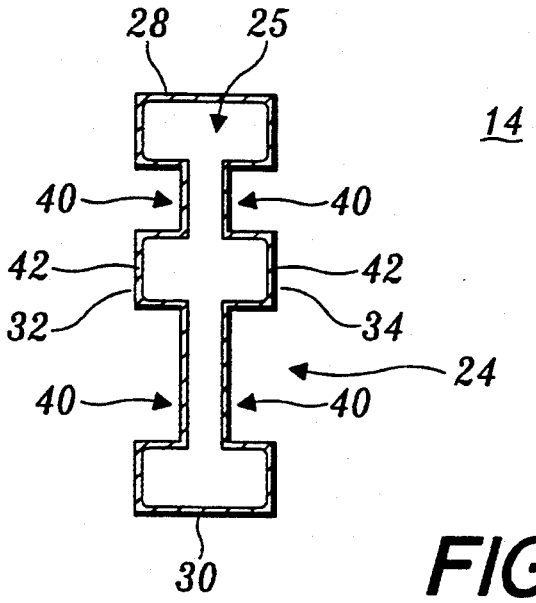
FIG. 4 shows a cross-sectional view of a lagging member constructed in accordance with the present invention taken substantially along line 4—4 of FIG. 3.

Reference is now had to FIG. 3 and 4 to describe the configuration of the lagging members 14. Each lagging member 14 is constructed from an integral, one-piece, unitary shell 24 that defines a cavity 25 therein. The shell 24 has a major wall 26 that defines parallel top and bottom surfaces 28 and 30, respectively, and parallel front and back surfaces 32 and 34, respectively. The shell 24 further defines parallel first and second endwalls 36 and 38, respectively, which together with the major wall 26 encloses the cavity 25. In the preferred embodiment shown in FIG. 3, the shell 24 has the overall configuration of a hollow parallelepiped plank, with the front and back surfaces 32 and 34 being contoured, however, for increased structural strength.

As shown in FIG. 1, the lagging members 14 are stacked transversely to and spanning between adjacent soldier piles 12. The bottom surface 30 of each upper lagging member 14 *a* rests on the top surface 28 of a lower lagging member 14 *b*. The number of lagging members 14 stacked atop of each other is determined in order to construct a soil retention wall 10 of a certain desired height.

Referring again to FIGS. 3 and 4, the major wall 26 of the lagging member 14 is contoured to define at least one, and preferably two or more, elongate external channels 40 on each of the front and back surfaces 32 and 34. In the embodiment shown, the front and back surfaces are mirror images of each other, with the lagging member 14 thus being symmetrical about a vertical plane. Each channel 40 extends completely from the first endwall 36 to the second endwall 38 of the lagging member 14, and has a central longitudinal axis that is oriented horizontally. Each channel 40 has a generally right-angled, U-shaped, cross-sectional configuration.

In the embodiment illustrated in FIGS. 3 and 4, each of the front and back surfaces 32 and 34 defines a lower channel 40 and an upper channel 40. A flat, elongate ridge 42 is defined between the external channels 40. Elongate corner edges 44 are defined at the outer extremities of the channels 40, as well as at the intersections of the front and back surfaces 32 and 34 with the top and bottom surfaces 28 and 30.

The external channels 40 formed by the contoured major wall 26 increase the surface area of the lagging member 14, thereby increasing the lagging member's strength. The exact number of the channels and ridges, as well as the cross-sectional configuration and spacing of the channels, can be varied as calculated to provide a lagging member having the desired structural strength and outer appearance for a particular application, as will be readily appreciated by those of skill in the art. For example, a plank-like lagging member with no exterior longitudinal channels could be formed, as could a lagging member with three or more external longitudinal channels.

In addition to increasing the strength of the lagging member, the external channels 40 also define conduits for access and insertion of structural reinforcing members, drains, application of grout, placement of electrical cabling, etc.

Each lagging member 14 is preferably formed by rotary molding a thermoplastic material, such as high-density polyethylene. One suitable material is commercially available recycled high-density polyethylene. Rotary molding has been found to be well suited for production of lagging members in accordance with the present invention, since the process yields a shell having substantially uniform wall thicknesses throughout. While rotary molding is preferred, it should be apparent to those of skill in the art that other molding techniques, such as bag molding, could be utilized instead.

One of the benefits of constructing the lagging members 14 from a molded synthetic polymer, such as a thermoplastic, is that the lagging members can be readily sawed, drilled, heat-welded, nailed, or riveted on the construction site.

Various alternate configurations of lagging members 14 may be constructed in accordance with the present invention. In each case, the lagging member is formed from a one-piece unitary polymeric shell. The exact configuration and contour of the shell is determined for the specific structural requirements and environment. For example, the lagging member could have an elongate cylindrical configuration. Several other potential alternative configurations are described below. Unless stated otherwise, each configuration of lagging member is intended for use in a soldier pile system.

Figure 5:
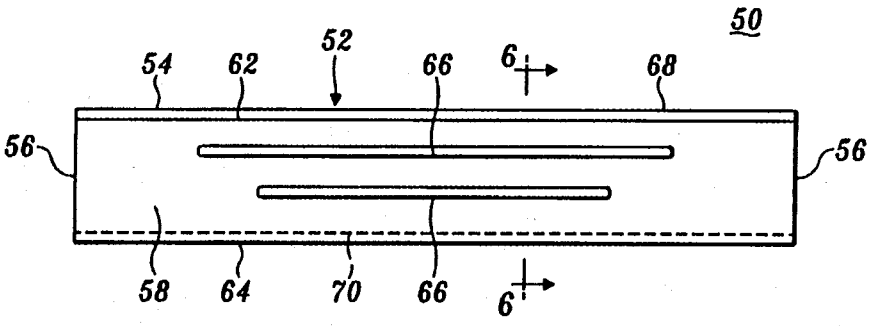
FIG. 5 shows a front view of an alternate polymeric lagging member constructed in accordance with the present invention.
Figure 6:
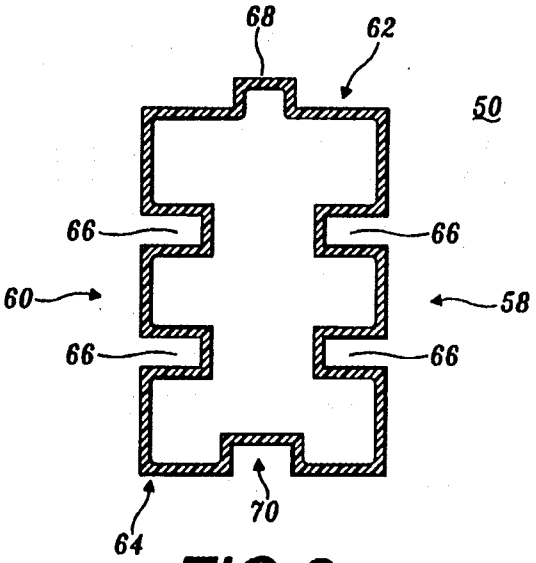
FIG. 6 shows a cross-sectional view of a lagging member taken substantially along line 6—6 of FIG. 5.

One alternate embodiment of a lagging member constructed in accordance with the present invention is shown in FIGS. 5 and 6. The lagging member 50 is constructed from an elongate polymeric shell 52 having a generally tubular major wall 54 and first and second endwalls 56, similar to that previously described with regard to the lagging member 14. The major wall 54 defines a front surface 58, back surface 60, top surface 62, and bottom surface 64. The front surface 58 and back surface 60 of the major wall 54 are each contoured, similarly to the lagging member 14, to define a plurality of longitudinal external channels 66. In the illustrated embodiment, each surface has two longitudinal channels 66 with outwardly opening, generally U-shaped cross sections. However, unlike the previous embodiment, the external channels 66 do not extend the full length of the major wall 54, instead terminating at a point spaced away from each of the endwalls 56. The width of each external channels 66 is also less than that of the previous embodiment. In addition to increasing the strength of the lagging member 50, the external channels 66 are designed as hand-holds to facilitate lifting and carrying of the lagging member 50 during placement.

The major wall 54 of the lagging member 50 is also configured to enable interlocked-stacking of the lagging members 50 upon installation. The top surface 62 is contoured to define an elongate, upwardly projecting engaging rib 68 that extends from the first endwall 56 to the second endwall 56. The engaging rib 68 has an inverted-U-shaped cross section that is centered on a vertical plane of symmetry of the lagging member 50. The bottom surface 64 of the lagging member 50 is correspondingly but inversely contoured to define an elongate engaging channel 70. The engaging channel 70 is contoured and dimensioned to match the engaging rib 68, such that when the lagging members 50 are stacked on top of each other the engaging rib 68 of a lower lagging member 50 is received within the engaging channel 70 of an upper lagging member. This serves to interconnect the stacked lagging members 50 together in the vertical direction, thereby strengthening the wall that is formed. The design of engaging ribs and engaging channels is such that an upper lagging member 50 can be lowered onto or slid longitudinally over a lower lagging member 50 during installation, if required. Although the lagging member 50 has been shown to include a rib on the top surface and a channel on the bottom surface, it should be apparent that the lagging member could be configured oppositely, with the rib on the bottom surface.

Figure 7B:
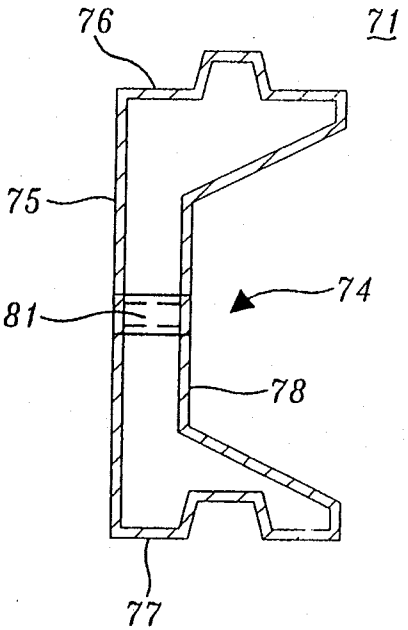
FIG. 7B shows a cross-sectional view of the lagging member of FIG. 7A, taken substantially along lines 7B—7B.
Figure 7A:
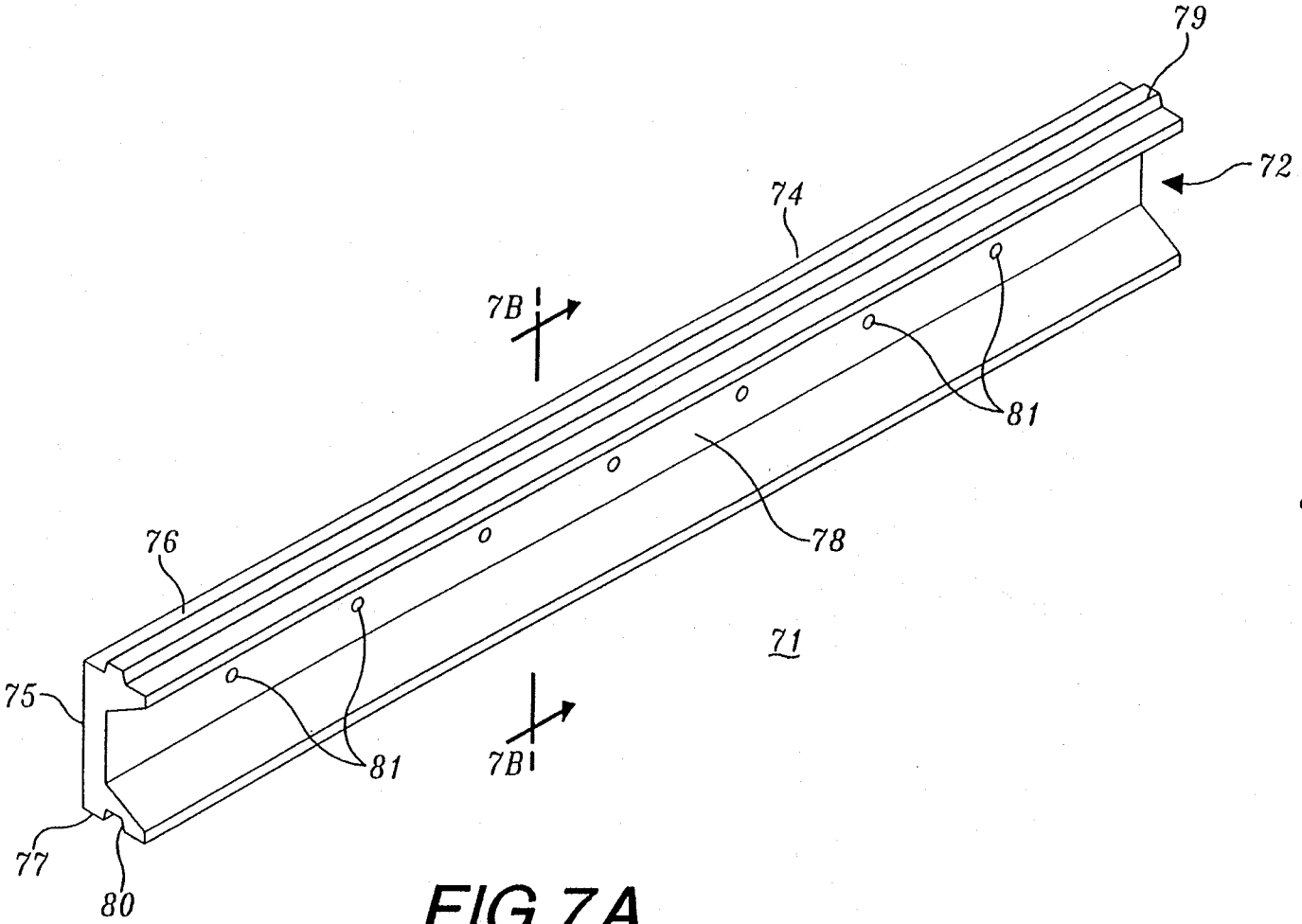
FIG. 7A shows a pictorial view of an alternate "C" section hollow polymeric lagging member.
Figure 7E:
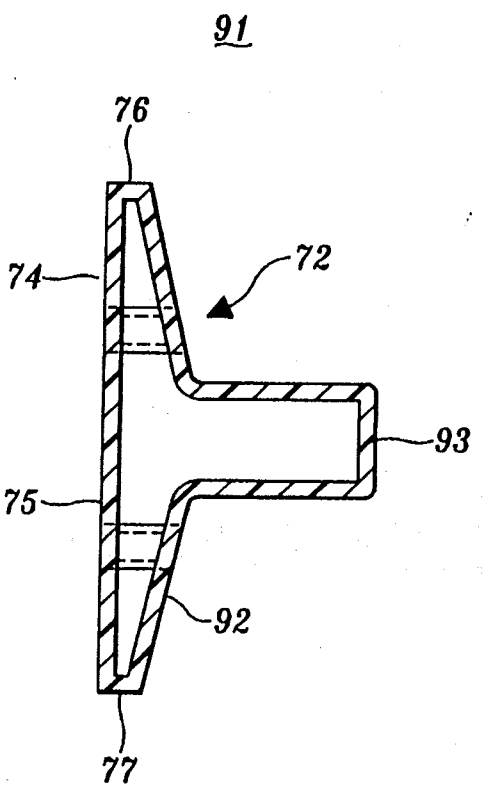
FIG. 7C, 7D and 7E show end views of "H", "E" and "T" section hollow polymeric lagging members, respectively.

As briefly discussed above, various structural configurations of hollow polymeric lagging members may be formed in accordance with the present invention, in order to provide the requisite structural strength for a particular application. Several additional examples of suitable structural configurations are shown in FIGS. 7A through 7E. Each of the embodiments shown in FIGS. 7A through 7C are similarly constructed, but define different structural-sections. To avoid redundancy, identical part number identifiers are used to identify similar features of each.

A first such example is the "C"-section member 71 shown in FIGS. 7A and 7B. The lagging member 71 is constructed from a one-piece polymeric shell 72 including a major wall 74 that defines a hollow, "C" shape in cross section, as shown in FIG. 7B. Thus, the major wall 74 defines a flat front surface 75 and parallel top and bottom surfaces 76 and 77, respectively, that project perpendicularly therefrom. The major wall 74 further includes a contoured back surface 78 that defines a rearwardly opening, broadened "C" shape, thus completing the "C"-section of the lagging member.

The lagging member 71 further includes an upper elongate engaging rib 79 formed on the top surface 76, and a corresponding engaging channel 80 formed in the bottom surface 77. A plurality of internal tubular passages 81 are formed by the major wall 74, each extending from the front surface 75 to the back surface 78, passing through the hollow interior of the shell therebetween. The passages 81 allow for water weepage from the soil retained by the wall after installation.

A further alternate structural configuration for a lagging member constructed in accordance with the present invention is shown in FIG. 7C. The lagging member 82 has a major wall 74 that defines a hollow, "H"-section. The major wall 74 thus defines opposing flat front and back surfaces 75 and 83, respectively, and opposing top and bottom surfaces 84 and 85, respectively. Each of the top and bottom surfaces 84 and 85 is contoured to define a deep, longitudinal channel 86 spanning the length of the lagging member.

Figure 7D:
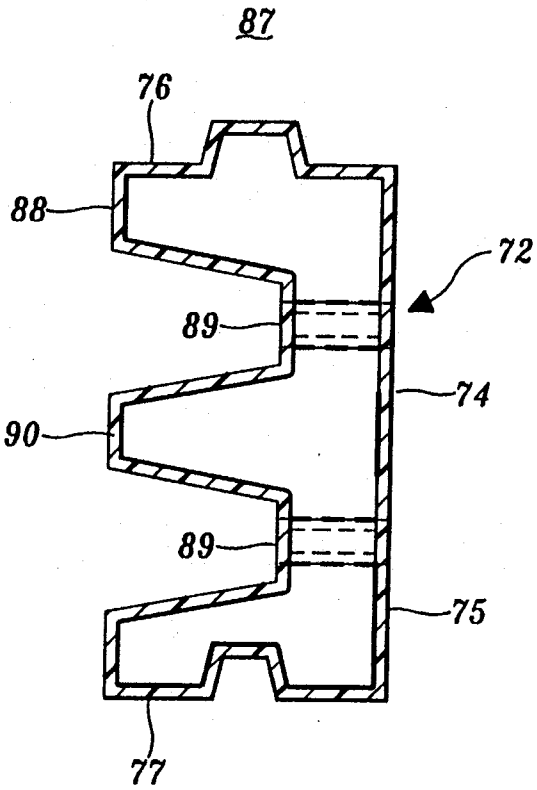
Figure 7C:
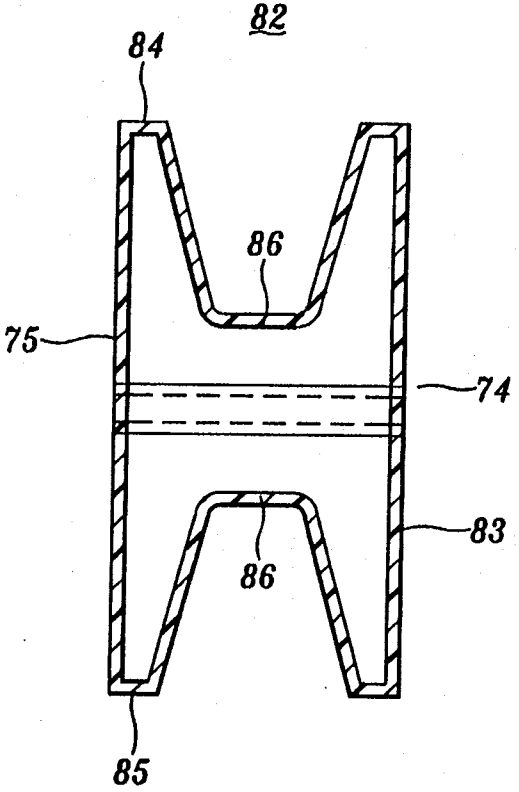

A still further alternate embodiment of a hollow, "E"-section lagging member 87 is shown in FIG. 7D. The shell 72 has a major wall 74 that defines a flat front surface 75, a top surface 76, and a bottom surface 77. A back surface 88 of the shell is contoured to define two rearwardly opening, U-shaped longitudinal channels 89 that extend the length of the lagging member, and a rearwardly projecting, longitudinal ridge 90 therebetween. The lagging member 87 thus has an overall hollow "E"-section configuration.

Another example is the hollow, "T"-section lagging member 91 shown in FIG. 7E. The lagging member 91 has a shell 72 including a major wall 74 that defines a flat front face 75 and narrow top and bottom surfaces 76 and 77, respectively. The back surface 92 of the lagging member 91 gradually tapers rearwardly from its intersections with each of the bottom and top surfaces 76 and 77, toward the center of the back surface 92. At its center, the back surface 92 is contoured to define an outwardly projecting, hollow, rectangular cross-sectioned ridge 93, thereby completing the overall hollow "T"-section. It should be apparent to those skilled in the art that numerous other structural shapes in addition to those shown in FIG. 7A through 7E can be designed for particular circumstances based on the disclosure included herein.

It should be apparent to those of skill in the art that rather than including the engaging rib and channels shown in FIGS. 5, 6, 7A, 7B, and 7D, the top and bottom surfaces of the lagging member 50 could be alternately formed for longitudinal engagement. For example, the top and bottom surfaces could be formed with a ship-lap configuration (not shown), the upper surface having a longitudinal recessed portion adjacent the front surface that receives a corresponding elongate downwardly projecting portion formed in the bottom surface of the next adjacent lagging member.

Figure 8:
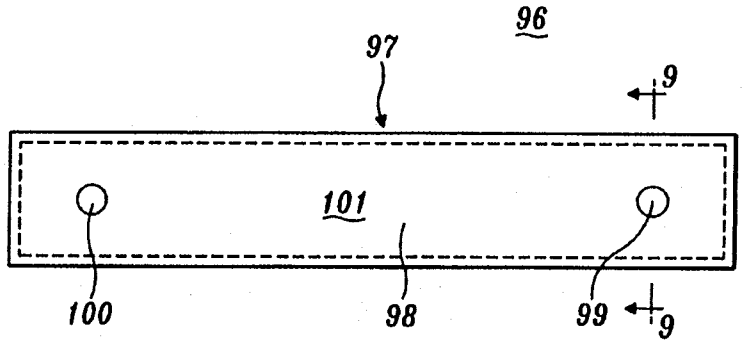
FIG. 8 shows a top view of a polymeric lagging plank constructed in accordance with the present invention and including grout and vent holes.
Figure 9:
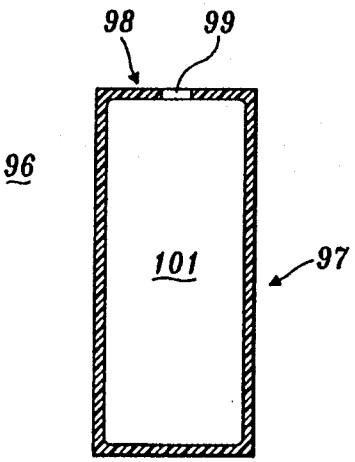
FIG. 9 shows a cross-sectional view of a polymeric lagging plank filled with concrete taken substantially along line 9—9 of FIG. 8.

Another alternate embodiment of a lagging member 96 is shown in FIGS. 8 and 9. The lagging member 96 is constructed similarly to the previously described lagging member 14, except as indicated. Rather than defining external elongate strengthening channels, the lagging member 96 is constructed from a polymeric shell 97 having a rectangular-parallelepiped configuration. The front and back surfaces of the shell 97 are flat, and thus the lagging member 96 has a shape similar to a conventional wooden plank.

The upper surface 98 of the lagging member 96 includes a fill aperture 99 proximate one end of the lagging member 96, and a vent aperture 100 proximate the opposite end of the elongate lagging member 96. The apertures 99 and 100 are cut through the shell 97 after formation of the lagging member 96, and open through the top of the upper surface 98 into the internal cavity 101 of the lagging member 96. The purpose of the apertures 99 and 100 is to allow filling of the lagging member 96 with concrete ("grout") after placement of the lagging member 96 in the soil retention wall. The concrete is introduced through the fill aperture 99, with air escaping through the vent aperture 100 as the internal cavity 101 is filled. The concrete filling increases the strength and weight of the lagging member 96. The empty lagging member 96 is lightweight for installation, and serves as an integral form for the concrete, remaining a permanent part of the wall. The shell 97 also serves as an environmentally resistant protective coating for the concrete. In lieu of grout, it should be apparent to those of skill in the art that the lagging member can also be left empty, or filled with other reinforcing material, such as plastic foam or sand.

While the lagging member 96 has been shown as having a rectangular-parallelepiped configuration, it should be apparent to those skilled in the art that the vent and fill apertures could be included in other hollow polymeric lagging members constructed in accordance with the present invention, such as those previously described in FIG. 1 through 7E.

Figure 10:
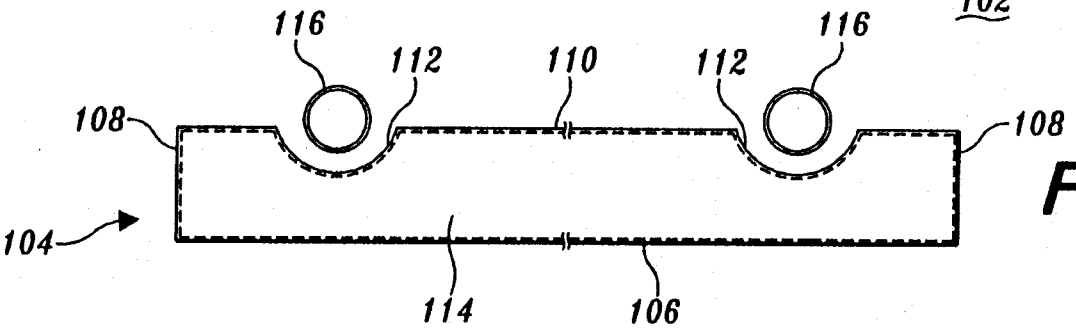
FIG.10 shows a top view of an alternate embodiment of a lagging member constructed in accordance with the present invention to include an external channel for drain placement.

A further alternate embodiment of a lagging member 102 is shown in FIG. 10. The lagging member 102 is constructed similarly to the previously-described lagging member 96, and thus has a polymeric, rectangular-parallelepiped shell 104 including a major wall 106 and first and second endwalls 108. A back surface 110 of the major wall 106 is contoured to define two external vertical channels 112 that extend upward from a bottom surface (not shown) to a top surface 114. Each channel 112 has a semi-cylindrical, trough-like contour, and is disposed proximate one of the endwalls 108 of the lagging member 102. The longitudinal axis of each channel 112 is oriented perpendicular to the longitudinal axis of the lagging member 102. However, it should be readily apparent to those of skill in the art that the exact number and placement of the vertical external channels 112 may vary, with one channel or more than two channels being included.

When lagging members 102 are stacked vertically atop each other to form a wall, the external vertical channels 112 of the stacked lagging member 102 align along a vertical axis. This permits the placement of drain pipes 116 within the channels 112 behind the soil retaining wall. Alternately, a layer of porous material such as INKA TM drain, filter fabric or other wicking material can be attached to the back surfaces 110 of the stacked lagging members 102, with water being collected by the porous material and then draining downwardly through the channels 112.

In addition to serving as drains or drain pipe receptacles, the vertical channels can also be filled with gravel for drainage purposes, or can be used for access to the back surface of the wall, for funneling grout after the wall is installed, or for the placement of utilities. Similarly, vertical external channels can be formed across the front surface of the lagging members 102 to receive vertical reinforcing members, such as structural beams.

Figure 11:
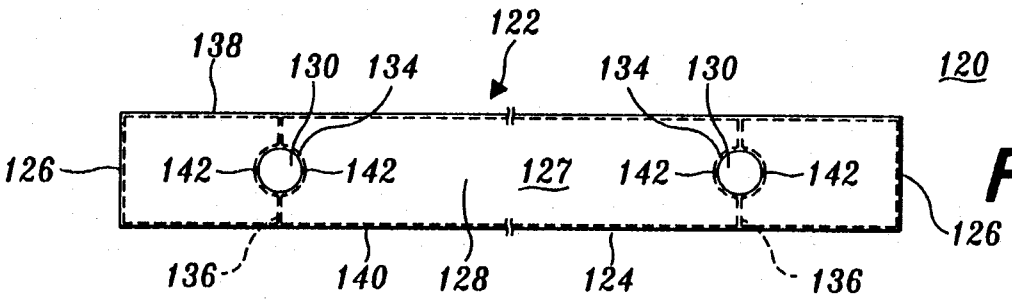
FIG. 11 provides a top view of an alternate lagging member constructed in accordance with the present invention and including an internal channel.

Lagging members can also be constructed in accordance with the present invention to include internal channels that are either vertically or horizontally disposed. One example is shown in FIG. 11, which illustrates a lagging member 120 constructed from an elongate polymeric shell 122 having a major wall 124 and first and second endwalls 126 that together define an internal cavity 127. The major wall 124 defines a top surface 128 and a parallel bottom surface (not shown). The major wall 124 is contoured to define two internal passages 130 that extend from the top surface 128 to the bottom surface, passing through the internal cavity 127 therebetween.

Each passage 130 has a tubular wall 134 that is integrally formed at the top end with the top surface 128 and at a bottom end with the bottom surface of the lagging member. The longitudinal axis of each tubular wall 134 is vertically disposed. The lagging member 120 also includes internal vertical baffles 136 that transversely bisect the internal cavity 127. Each baffle 136 intersects a wall 134 of one of the corresponding passages 130. Each baffle 136 thus has two portions, spanning from opposite sides of the corresponding wall 134 rearwardly to the back surface 138 of the lagging member 120 and forwardly to the front surface 140 of the lagging member, respectively, thereby strengthening the major wall 134.

The vertical internal passages 130 of stacked lagging members 120 align along a vertical axis, thereby permitting the introduction of concrete or structural reinforcing members. In order to facilitate concrete filling of the cavities 127 of stacked lagging members 120, a plurality of transverse apertures 142 are preferably formed radially through the wall 134 of each passage 130, thereby allowing fluid communication between the passages 130 and the internal cavities 127. The internal cavities 127 of stacked lagging members 120 can thus be filled by pumping concrete through the aligned passages 130, whereby the concrete flows through the apertures 142 into the partitioned internal cavities 127.

Although the passages 130 have been shown as vertically disposed, it should be readily apparent to those skilled in the art that they could instead be horizontally disposed, extending from a first endwall 126 to a second endwall 126, passing through the internal cavity 127 therebetween. Such horizontal internal passages (not shown) could be used for the insertion of steel structural members, such as reinforcing bars, or utilities.

Figure 12:
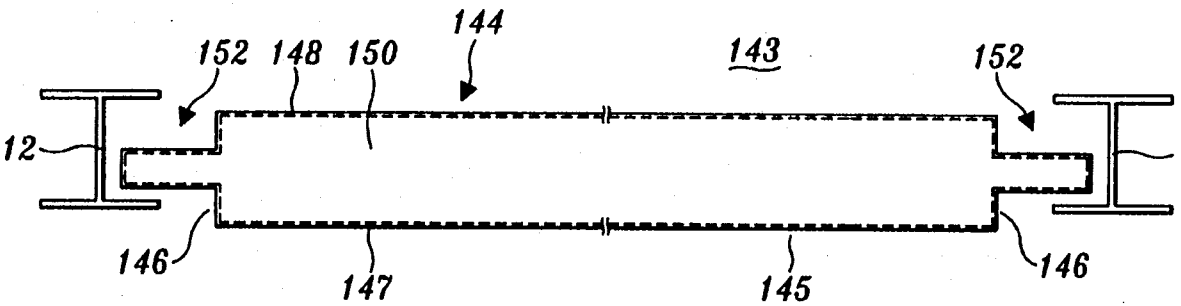
FIGS. 12 and 13A show schematic top views of lagging members constructed in accordance with the present invention engaged with piles, wherein the lagging members are contoured to include pile-engaging ends configured as engaging flanges or tubes, respectively.

The lagging members described above have each included substantially flat endwalls. However, the ends of lagging members constructed in accordance with the present invention may optionally be contoured to conform to and engage with the soldier piles 12. One such example is shown in FIG. 12: A lagging member 143 is formed from a polymeric shell 144 including a major wall 145 and endwalls 146. The major wall defines a front surface 147, a back surface 148, a top surface 150, and a bottom surface (not shown).

The lagging member 143 has an elongate rectangular-parallelepiped shape. However, rather than being flat, each endwall 146 is contoured to form a hollow engaging fin 152 that projects longitudinally outward from a plane defined by the endwall 146. Each fin 152 is vertically oriented, extending from the bottom surface to the top surface 150, and extending outwardly from the endwall 146 sufficiently to be received between the surface flanges of an "H"-beam soldier pile 12 upon installation. Each fin 152 has a rectangular perimeter.

Figure 13A:
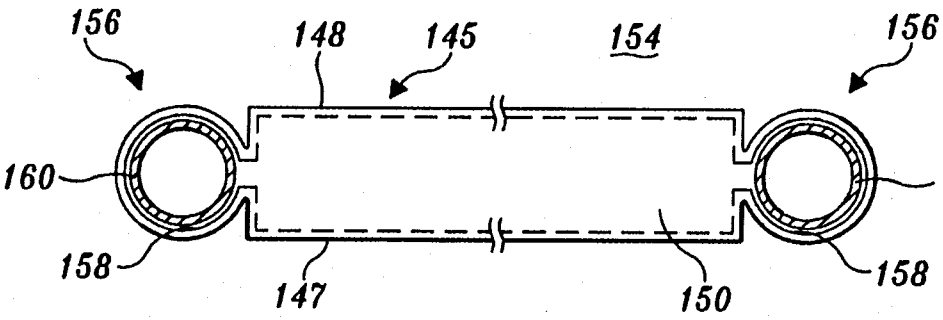
Figure 13B:
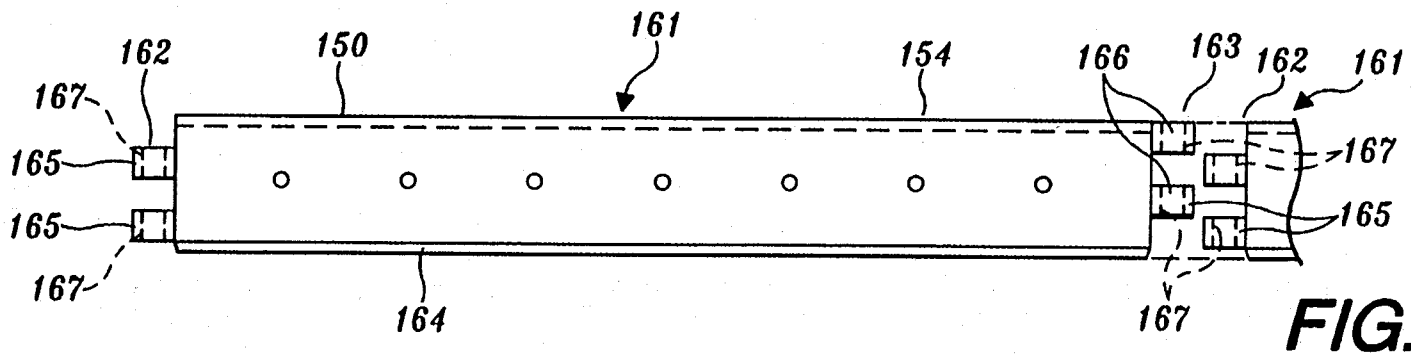
FIG. 13B shows a front view of a lagging member constructed with tubular-hinge end walls, and a partial front view of an identically constructed second lagging member.
Figure 13C:
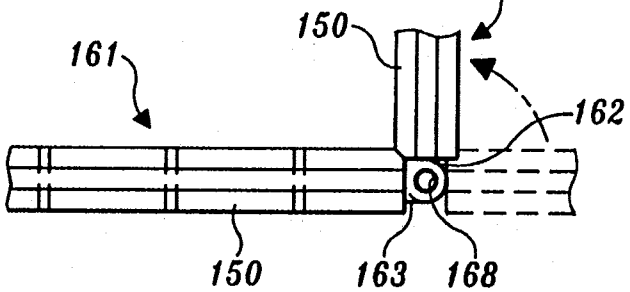
FIG. 13C shows a partial top view of two of the lagging members of FIG. 13B coupled by a pipe.
Figure 14:
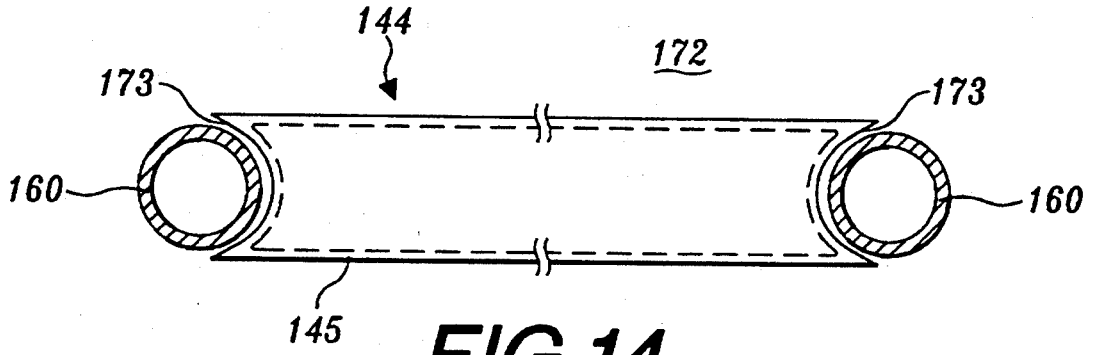
FIGS. 14 and 15 show schematic top views of lagging members constructed in accordance with the present invention engaged with piles, wherein the lagging members are contoured to include pile-engaging ends configured as partial cylinders or as a beveled end (partial view of one end), respectively.
Figure 15:
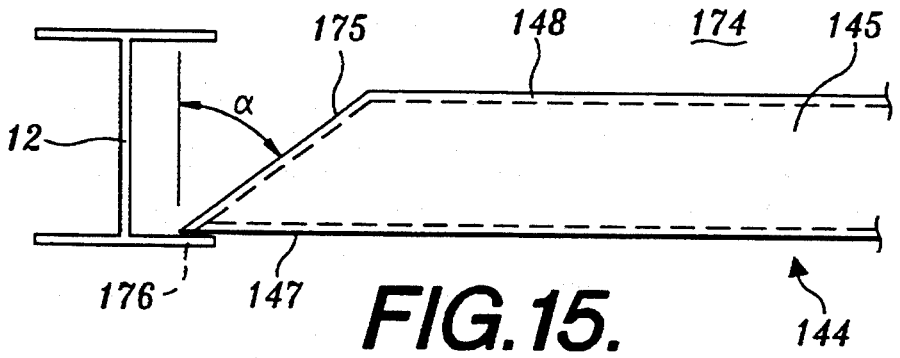

Numerous other configurations for contouring the ends of lagging members constructed in accordance with the present invention to engage with soldier piles are possible, and several further examples are shown in FIGS. 13–15. The lagging members shown in FIGS. 13–15 are constructed similarly to the lagging member 143 shown in FIG. 12, except as described, and thus identical part numbers are used to identify features that function similarly.

The lagging member 154 shown in FIG. 13A has a major wall 145 and two tubular endwalls 156. Thus, proximate to each end of the lagging member 154, the major wall 145 necks inwardly, with the parallel front surface 147 and back surface 148 almost contacting each other at this point. The major wall 145 then flares back outwardly on either side in an arcuate fashion, meeting again at the extreme ends of the lagging member 154, thereby forming the endwalls 156. Each tubular endwall 156 is contiguously formed with the major wall 145, and has a longitudinal axis that is vertically disposed.

For each tubular endwall 156, a circular opening 158 is cut through the top surface 150 of the lagging member 154, and is centered on the longitudinal axis of the tubular endwall 156. A corresponding opening (not shown) is cut through the bottom surface of the lagging member and is also centered on the longitudinal axis of the tubular endwall 156. This allows a cylindrical pile 160, such as a steel pipe, to be received within the tubular endwall 156, passing through the aligned openings 158. The longitudinal axis of the cylindrical pile 160 is thus aligned with the longitudinal axis of the tubular endwall 156. The lagging members 154 can be stacked between two adjacent cylindrical piles 160, with the tubular endwalls 156 of the lagging members 154 sliding over corresponding piles 160. The piles 160 are placed side-by-side in spaced pairs, in order to form a soil retaining wall.

A variation of the lagging member 154 of FIG. 13A is shown in FIGS. 13B and 13C. The illustrated lagging member 161 has an elongate major wall 154 and first and second tubular end walls 162 and 163. However, the open tubes defined by the end walls 162 and 163 do not extend the full height of the lagging member 154 from the bottom surface 164 to the top surface 150. Instead, the first end wall 162 is broken into two shorter tubular portions 165. A first tubular portion 165 of the first end wall 162 is disposed adjacent the bottom surface 164, and a second tubular portion 165 is spaced above the first tubular portion 165.

The second end wall 163 of the lagging member 161 is similarly formed, but includes a first :short tubular portion 166 adjacent the top surface of the lagging member 161, and a second short tubular portion 166 spaced below the first tubular portion 166. Referring to FIG. 13B, the tubular portions 165 and 166 are disposed to intermesh when the first end 162 of one lagging member 161 is mated with the second end 163 of another lagging member 161. When so mated, vertical passages 167 within each of the intermeshed tubular portions 165 and 166 align.

Referring to FIG. 13C, a pipe pile 168 is then inserted through the aligned passages of the intermeshed tubular endwalls 162 and 163 of the mated lagging members 161. The pipe pile 168 serves to interconnect the lagging members 161, while also permitting one lagging member 161 to pivot relative to the other lagging member 161, as indicated by the arrow in FIG. 13C. Thus the mated lagging members 161 and pipe pile 168 form a hinged connection, facilitating the building of curved retaining walls. It should also be apparent that mated lagging members 161 can be stacked on top of each other, interconnected by pipe piles 168 inserted therethrough.

Another alternate endwall configuration is shown in FIG. 14. A lagging member 172 has a polymeric shell 144 including a major wall 145 and two inwardly curved endwalls 173. Each of the endwalls 173 defines a semi-cylinder having a longitudinal axis that is vertically disposed. Each endwall 173 receives the side of a cylindrical pile 160. When the lagging members 172 are stacked between two adjacent piles 160 each lagging member 172 is secured by the engagement of the endwalls 173 with the piles 160 against falling either forwardly or rearwardly.

Still another alternate end configuration for a lagging member 174 is shown in FIG. 15. The lagging member 174 is formed from a polymeric shell 144 including a major wall 145. The major wall 145 defines a front surface 147 and a parallel back surface 148. On each end of the lagging member 174, a flat endwall 175 is formed that extends at an acute angle from the front surface 147 to the back surface 148. The angle of inclination of the endwall 175 is equal to $90-\alpha$, wherein $\alpha$ is from greater than 0° to 80°. The lagging member 174 thus has a beveled end, with the beveled surface presented by the endwall 175 being disposed vertically. The advantage of this construction is that the extreme end 176 of the lagging member 174 can be sheared to shorten the lagging member 174 slightly, thereby accommodating potential misplacement of the soldier piles 12.

Figure 16:
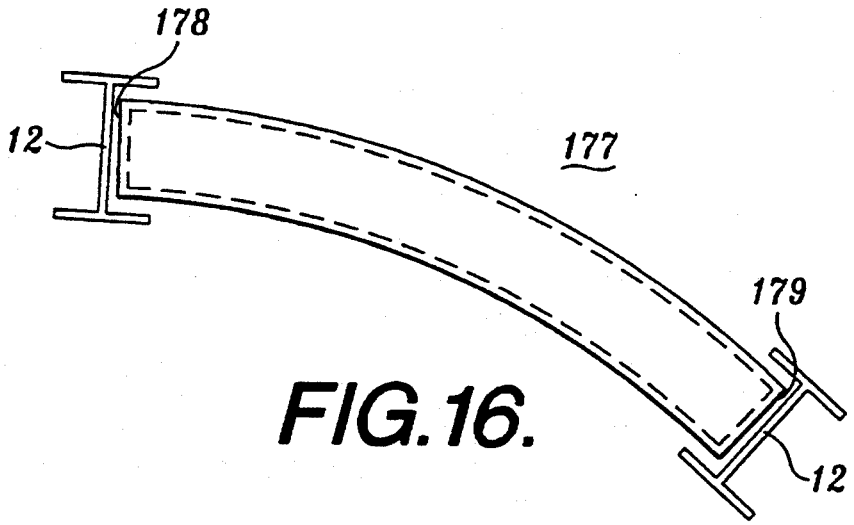
FIG. 16 shows a schematic top view of an arcuate soil retaining wall constructed in accordance with the present invention.

The previous preferred embodiments of lagging members described above have each had a longitudinal axis that defines a straight line from end-to-end. It should be apparent to those skilled in the an that the lagging member can instead be arcuately contoured from end-to-end, such as the curved lagging member 177 shown in FIG. 16. The elongate lagging member 177 is constructed similarly to that previously described and shown in FIGS. 8 and 9, but defines an arc between a first end 178 of the lagging member and a second end 179 of the lagging member. This facilitates the building of soil retention walls that curve either inwardly or outwardly.

The previous preferred embodiments of lagging members have all been described for use with soldier piles in order to secure the lagging members together to form a wall. However, the lagging members of the present invention are also well-suited for use with other types of securement mechanisms, in addition to or in lieu of soldier piles. For example, tie-back elements connecting the lagging to deadman elements buried in the soil behind the wall may be utilized. An example of such a soil retention wall is shown in FIGS. 17 through 19.

The illustrated soil retention wall 180 includes a plurality of spaced vertical H-beam soldier piles 12, as described for the previous first preferred embodiment. A plurality of lagging members 182 are stacked transversely between adjacent soldier piles 12. The lagging members 182 are of hollow polymeric construction, and may optionally be filled with concrete. The lagging members 182 are illustrated and constructed substantially the same as the previously-described lagging members 50 (FIG. 5) and include at least one external longitudinal channel for gripping purposes. In place of at least one lagging member 182, a tie-back lagging member 184 is included in the stack. Additional tie-back lagging members 184 may also be included, as needed.

The tie-back lagging member 184 is formed from a polymeric shell 186 including a major wall 188 and first and second endwalls 190. The major wall 188 defines a substantially flat front surface 192 in which several external longitudinal channels 194 are formed for gripping purposes and strengthening. The major wall 188 also defines a bottom surface 196, a top surface 198, and a back surface 200 (FIG. 18).

Figure 17:
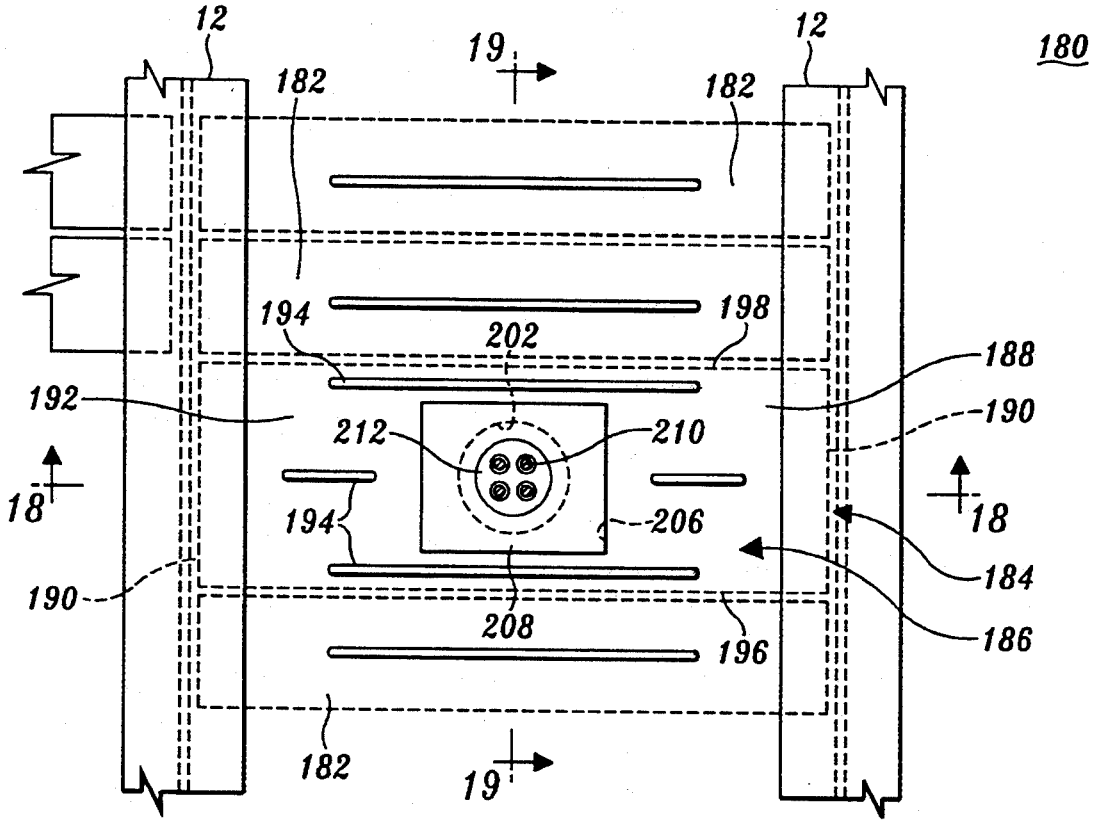
FIG. 17 includes a front plan view of a soil retention wall constructed in accordance with the present invention and including a tie-back anchor.
Figure 18:
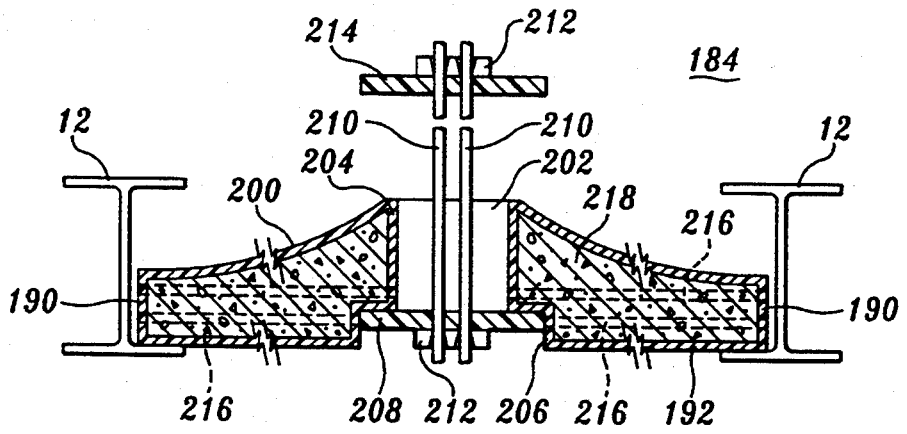
FIG. 18 provides a cross-sectional view of a tie-back soil retention wall taken substantially along line 18—18 of FIG. 17.
Figure 19:
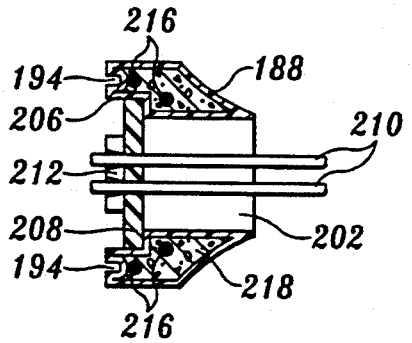
FIG. 19 shows a cross-sectional view of a tie-back lagging member taken substantially along line 19—19 of FIG. 17.

Referring to FIGS. 17 and 18, the major wall 188 defines a central internal passage 202 that extends horizontally from the front surface 192 to the back surface 200. As for the previously-described internal passages, the internal passage 202 includes a tubular wall 204. The back surface 200 of the lagging member 184 tapers outwardly (i.e., away from front surface 192) from the endwalls 190 toward the rearward end of the internal passage 202. The lagging member 184 is thus thicker in the center than it is at the ends.

The major wall 188 is also configured to define a rectangular recess 206 in the front surface 192 surrounding the internal passage 202. A flat, rectangular anchor plate 208 is received within the recess 206. Tie-back members, such as steel tie-back cables 210, pass through apertures formed in the anchor plate 208 and extend inwardly through the internal passage 202. In the illustrated example, four cables 210 are used to tie back the lagging member 184. A first end of each tie-back cable 210 is secured on the outer surface of the anchor plate 208 by frictional engagement within beveled apertures formed in a cap plate 212 or by other conventional means. The tieback cables 210 extend rearwardly from the anchor plate 208, through the internal passage 202, and back into the soil that is retained by the wall 180. A second remote end of each tie-back cable 210 is secured to a deadman element 214, such as a large, vertically disposed plate. The tie-back cables 210 are secured to the deadman element, such as by passing through apertures in the deadman element 214 and being secured to a second cap plate 212. As is known in the art, the soil loads imposed on the lagging member 184 are transmitted through the tie-back cables 210 to the deadman element 214.

Additionally, soil loads are transferred to the piles 12 by the lagging member 184. To facilitate this transfer, elongate reinforcing members 216, such as lengths of steel reinforcing bar, are placed within the internal cavity 218 of the hollow lagging member 184. The reinforcing members 216 are inserted through holes cut in a first endwall 190 of the lagging member, and pass longitudinally and horizontally through the lagging member's cavity 218, exiting a second set of holes cut in the opposing endwall 190 of the lagging member. The reinforcing member 216 are installed to lie adjacent the internal passage 202 within the cavity 218, and thus pass behind the edges of the anchor plate 208. After placement in the wall, the internal cavity 218 of the lagging member 184 is filled with concrete, by the manner previously described above, encapsulating the reinforcing members 216. In the preferred embodiment illustrated, four reinforcing members 216 are utilized (FIGS. 18 and 19); however, it should be readily apparent to those of skill in the art that more or less reinforcement can be used as required for the specific structural application. Additionally, it should be apparent in view of the disclosure above that preformed, walled internal passages could be included in the lagging member 184 to receive the reinforcing members 216.

Figure 20:
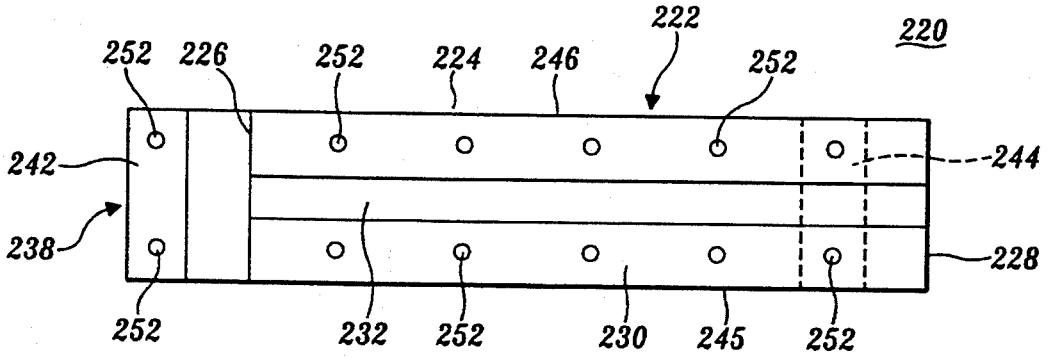
FIG. 20 shows a side view of a lagging member constructed in accordance with the present invention and having interlocking ends.
Figure 21:
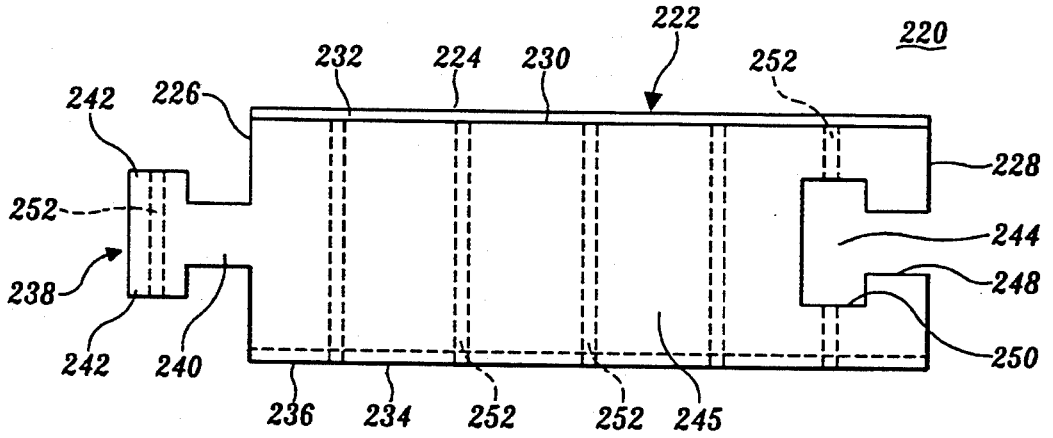
FIGS. 21 and 22 provide top and fight end views, respectively, of the lagging member shown in FIG. 20.
Figure 22:
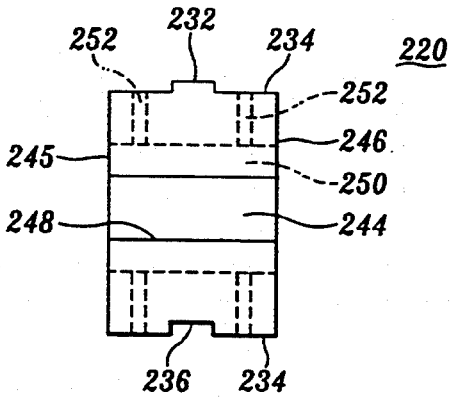

Rather than using soldier piles to secure the stacked lagging members of the present invention together end-to-end, the lagging members can be formed to include interlocking ends. One such configuration for a lagging member 220 with interlocking ends is shown in FIGS. 20–22. As for the previously-described embodiments, the lagging member 220 is formed from a polymeric shell 222 including a major wall 224, a first endwall 226, and a second endwall 228. The top surface 230 of the major wall 224 is formed to include an elongate engaging rib 232, while the bottom surface 234 is formed to include a corresponding but inversely contoured engaging channel 236, as previously described in relation to the lagging member 50 of FIGS. 5 and 6. The rib 232 and channel 236 serve to interconnect the stacked lagging members 220 in the vertical direction.

The endwalls 226 and 228 are configured to interconnect and interlock the lagging members end-to-end in order to form a wall without the necessity for using soldier piles for low-wall applications, although soldier piles may also be used and placed in front of the wall, for taller walls. The first endwall 226 is contoured to define a hollow, "T"-shaped interlocking rib 238. The interlocking rib 238 extends the full width of the lagging member 220 (FIG. 20), and has a narrow neck portion 240 (FIG. 21 ) that is centered midway between the top surface 230 and the bottom surface 234. The neck portion 240 terminates at its outer end to form upwardly and downwardly projecting ridge portions 242. The interlocking rib 230 is thus wider (in the vertical direction) at its outermost end than it is proximate to the first endwall 226.

The second endwall 228 is contoured to define an inversely but correspondingly contoured interlocking channel 244. The channel 244 extends the full horizontal width of the lagging member 220 from the front surface 245 to the back surface 246. The channel 244 thus defines a horizontal slot 248 formed across the second endwall 228. The slot 248 opens into an enlarged horizontal passage 250 (i.e., the head of the "T"-shaped channel) formed by the inner extremity of the interlocking channel 244.

When lagging members 220 are used to construct a retaining wall, the interlocking rib 238 of a first lagging member 220 is slid horizontally into the interlocking channel 244 formed in the opposite end of the next adjacent lagging member 220. Because of the engagement of the ridges 242 of the interlocking rib 238 and the horizontal passage 250 of the interlocking channel 244, the interconnected lagging members 220 cannot be separated in the longitudinal direction.

In addition to including the upper engaging rib 232 and lower engaging channel 236, the lagging members 220 are also constructed to enable vertical interlocking with structural reinforcing members, such as a steel reinforcing bar. A plurality of vertical internal passages 252 are formed through the lagging member 220, extending from the top surface 230 to the bottom surface 234. As previously described relative to the lagging member 120 shown in FIG. 11, each of the internal passages includes a tubular wall having a longitudinal axis that is vertically disposed. In the embodiment shown in FIGS. 20 through 22, the internal passages 252 are arranged at spaced intervals along either side of the engaging rib 232 and engaging channel 236. In addition to being formed through the body of the major wall 224, the internal passages 252 also are formed through the interlocking rib 238 and the interlocking channel 244, at either end of the lagging member 220. Thus, after lagging members are interconnected end-to-end, and then stacked in vertical courses, lengths of reinforcing steel can be inserted through the stacked lagging members 220 to further interconnect the members 220. The reinforcing members pass through the interlocked ribs 238 and channels 244, thereby preventing the lagging members 220 from sliding transversely relative to each other in the horizontal direction.

Figure 23:
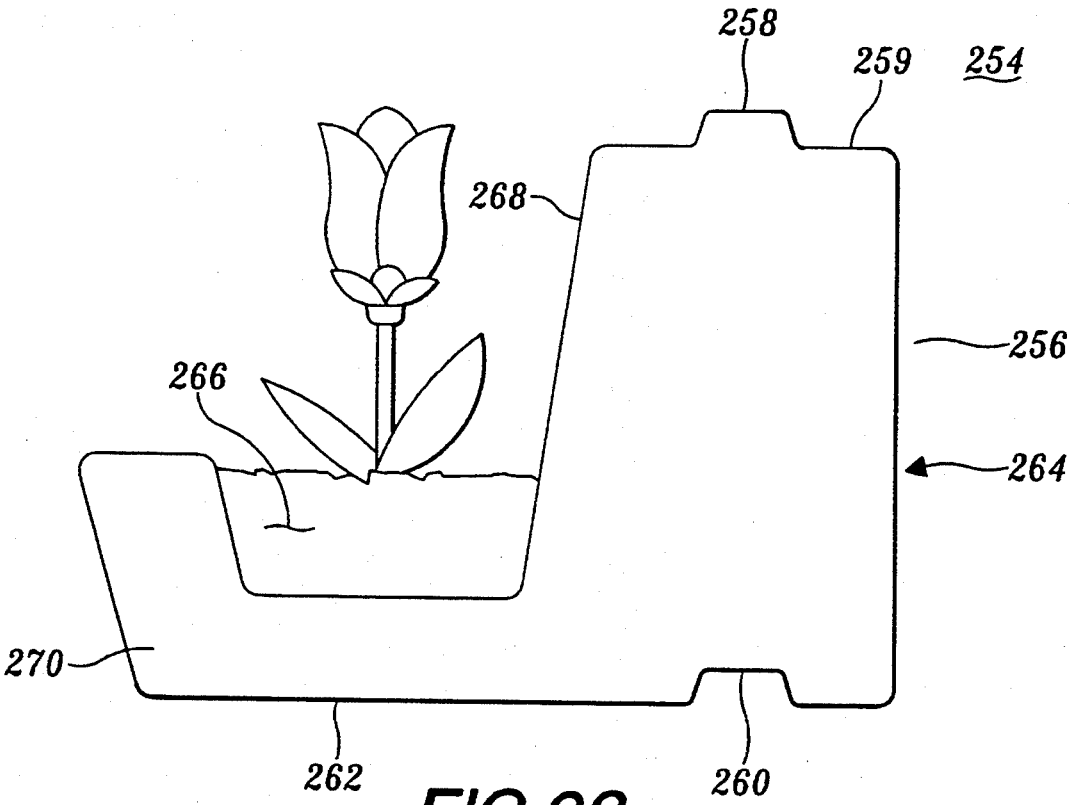
FIG. 23 shows a cross-sectional view of an alternate embodiment of the polymeric lagging member constructed in accordance with the present invention and including a plant trough formed thereby.

A still further alternate embodiment of a lagging member 254 is shown in FIG. 23. The lagging member 254 is constructed substantially the same as the lagging member 50 previously described and shown in FIGS. 5 and 6. The lagging member 254 is formed from a polymeric shell 256, and includes an elongate engaging rib 258 on its top surface 259 and a corresponding but inversely contoured elongate engaging channel on its bottom surface 262. However, the major wall 264 of the lagging member 254 is contoured to define a trough 266 disposed forwardly and below the front surface 268 of the lagging member, in order to receive plantings.

The trough 266 is formed integrally with the lagging member 254 by the major wall 264. The bottom surface 262 of the lagging member 254 extends forwardly of the front surface 268, and then projects upwardly therefrom. The major wall 264 then projects inwardly towards the front surface 268, back downwardly toward, but above, the bottom surface 262, and then back inwardly to intersect with the front surface 268. A double-walled trough projection 270 is thus formed, which projects forwardly of the front surface 268 and upwardly from the bottom surface 262, thereby defining the trough 266, which extends the full length of the lagging member 254. Several lagging members 254 including plant troughs 266 can be incorporated at intervals along the height of a wall constructed in accordance with the present invention, or the entire wall can be constructed from the lagging members 254. Plants such as vines, flowers, or bushes can be planted in soil placed within the troughs 266 to render a more attractive external surface to the wall.

Figure 24:
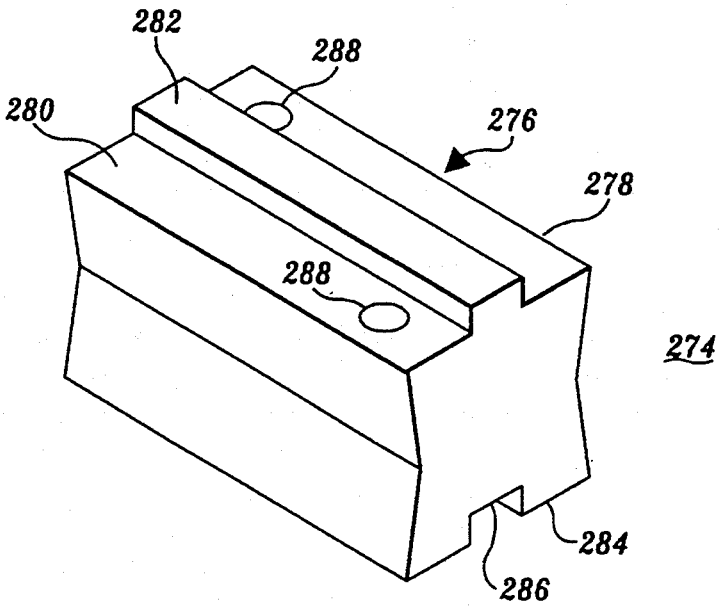
FIG. 24 shows a pictorial view of a polymeric gabion module constructed in accordance with the present invention.

The lagging members 254 described thus far have been generally elongate and are interconnected together, either by interlocking ends or solder piles. It is also possible to construct hollow polymeric gabions 274 in accordance with the present invention, as shown in FIG. 24. The gabions 274 are essentially large box-like containers that receive rocks, concrete or other dense material, and which are stacked to retain a slope. Each gabion 274 is formed from a polymeric shell 276 and includes a major wall 278 defining a top surface 280, which includes an upwardly projecting elongate engaging rib 282. The major wall 278 also defines a flat bottom surface 284 that includes an inversely contoured engaging channel 286. Apertures 288 are formed in the top surface 280 of the gabion for the receipt of rocks or concrete.

Figure 25:
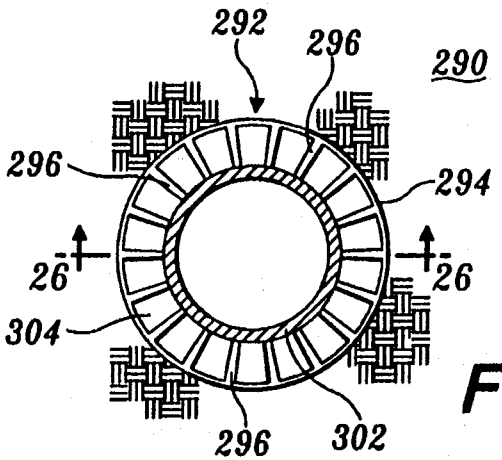
FIG. 25 shows a top plan view of installed polymeric shaft excavation supports constructed in accordance with the present invention.
Figure 26:
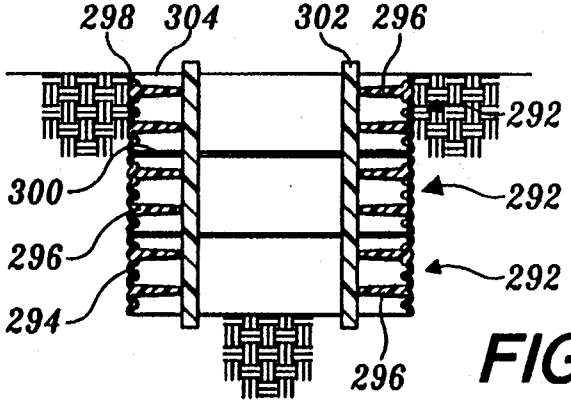
FIG. 26 shows a cross-sectional view of stacked shaft excavation supports taken substantially along line 26–26 of FIG. 25.

A still further embodiment of the present invention is shown in FIGS. 25 and 26. A cylindrical shaft support 290 is formed from a plurality of stacked cylindrical support sections 292. Each support section 292 includes a tubular shell portion 294. The shell portion is circumferentially corrugated, thereby defining a series of circumferential ridges. Each support section 292 further includes a plurality of elongate spacer fingers 296 that project radially inward from the inner surface of the shell portion 294. Each spacer finger 296 has an elongate, cylindrical, rod-like configuration. The spacer fingers 296 are arranged at spaced intervals (FIG. 25) about the circumference of the shell portion 294. As shown in FIG. 26, the spacer fingers 296 are arranged in a first upper circular pattern proximate the upper edge 298 of each support section, and a lower circular pattern proximate the lower edge 300 of the support section. The shell portion 294 and spacer fingers 296 of each of the shaft supports are preferably integrally formed, having a one-piece, unitary construction. The support sections 292 may be rotary molded from a thermoplastic material such as polyethylene.

To form the shaft support 290, the support sections 292 are stacked one on top of the other, with the central axis of each being aligned. To facilitate alignment during stacking, the upper and lower edges 298 and 300 of each support section may be formed with mating annular flanges (not shown). A cylindrical liner 302 is inserted through the center of the stacked support sections 292, defining an annular space 304 between the outer surface of the cylindrical liner 302 and the inner surface of the shell portion 294. The spacer fingers 296 serve to locate and center the liner 302 within the shell portions 294, and thus extend radially across the annular space 304.

The support sections 292 and liner 302 are assembled within an excavated shaft. Concrete or grout can then be pumped in between the aligned shell portions 294 and the liner 302, filling the annular space and surrounding the spacer fingers 296. A rigid shaft support is thus formed, ensuring against collapse of the excavated shaft.

Figure 27:
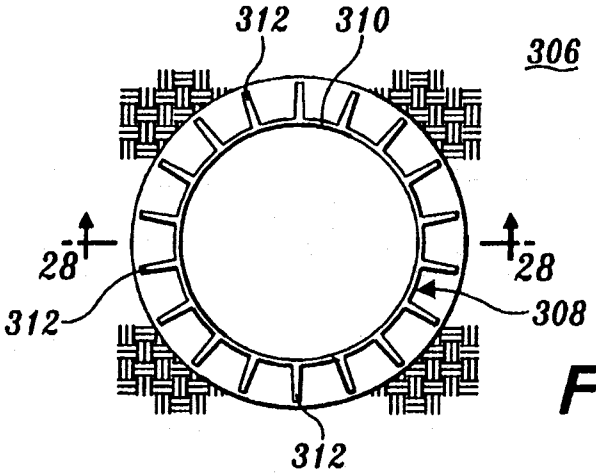
FIG. 27 shows a top plan view of installed alternate polymeric shaft excavation supports constructed in accordance with the present invention.
Figure 28:
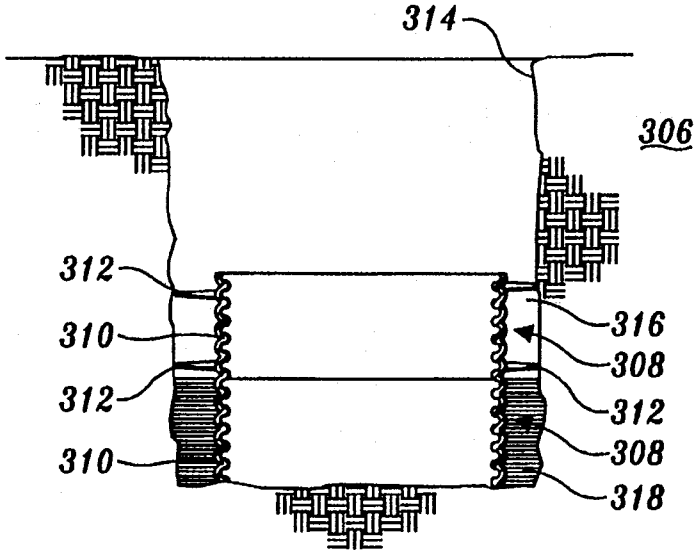
FIG. 28 shows a cross-sectional view of the alternate shaft excavation support taken substantially along line 28—28 of FIG. 27.

An alternate embodiment of a shaft support 306 is shown in FIGS. 27 and 28. The shaft support 306 is made from a plurality of stacked support sections 308. Each support section 308 is constructed similarly to the previously-described support sections 292, except that spacer protuberances are arranged on the outer circumference of a corrugated shell portion 310. Thus, a plurality of spacer fingers 312 project radially outward at spaced intervals from the outer circumference of the shell portion 310. As for the previously-described embodiment, each of the spacer fingers 312 has an elongate, generally cylindrical configuration. Instead of using a separate cylindrical liner, the support sections 308 are stacked directly into an excavated shaft 314, with the spacer fingers 312 projecting toward the earth shaft. An annular space 316 is thus defined between the shell portion 310 and the shaft 314, with the spacer fingers 312 projecting inwardly into this annular space 316. Concrete 318 is then pumped to fill the annular space 316 and complete the shaft support.

Although each of the support sections 292 and 308 have been described above as comprising complete cylinders, it should be readily apparent to those skilled in the art that each support section 292 or 308 could instead be constructed from a plurality of radial sectors that are placed end-to-end to form the cylinder. Additionally, the number, shape and arrangement of spacer fingers shown in the FIGS. 25 through 28 is provided by way of example, only, and it should be readily apparent that the size, number and arrangement of spacer protuberances can be varied within the scope of the present invention.

Lagging members may also be constructed in accordance with the present invention to form a soil retaining wall for facing a slope or bank that has been tensile-reinforced with sheets of soil-grid. "Soil-grid" refers to thin sheets of high-tensile plastic material which includes a plurality of elongated apertures arranged and repeated in a two-dimensional array pattern. One commercially available type of soil-grid is available under the trademark GEO-GRID TM from the Tensar Corporation. In use, layers of soil-grid are placed between compacted layers of earth to reinforce a bank or slope. An edge portion of each sheet of soil-grid projects outwardly from the earth embankment. The reinforced embankment and exposed soil-grid edges are conventionally surfaced with concrete that is cast in place.

Figure 29:
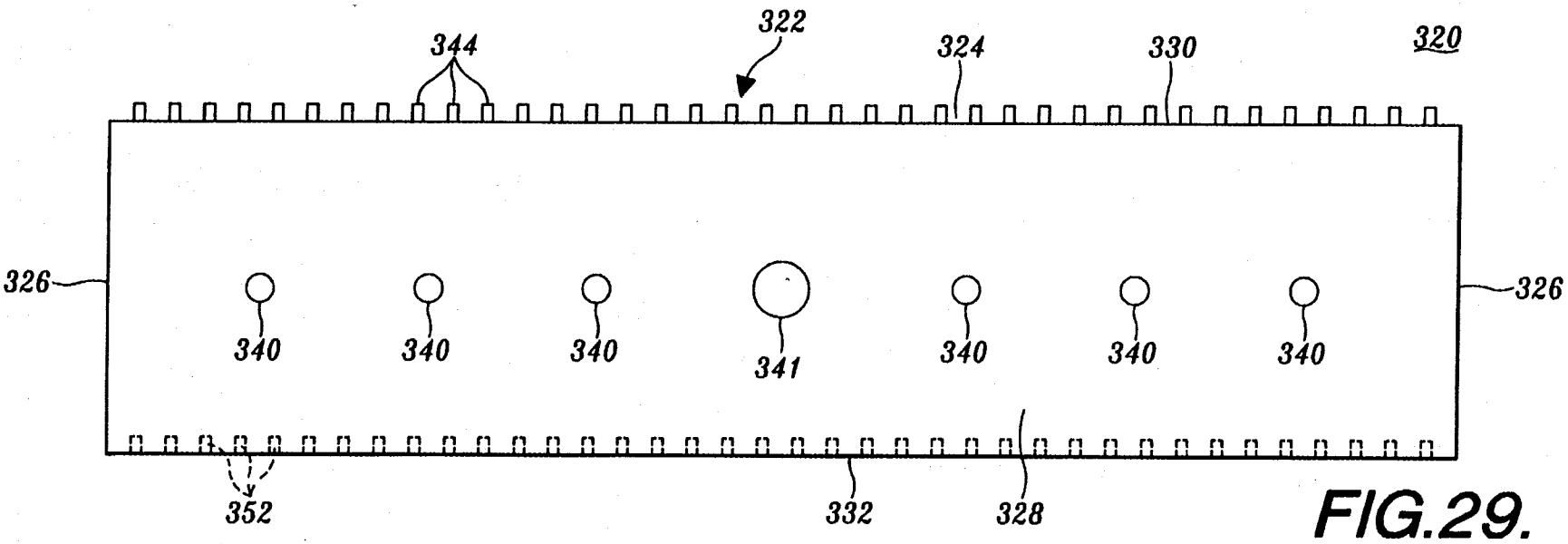
FIG. 29 shows a front view of an alternate lagging member of the present invention facing a slope reinforced with soil-grid.
Figure 30:
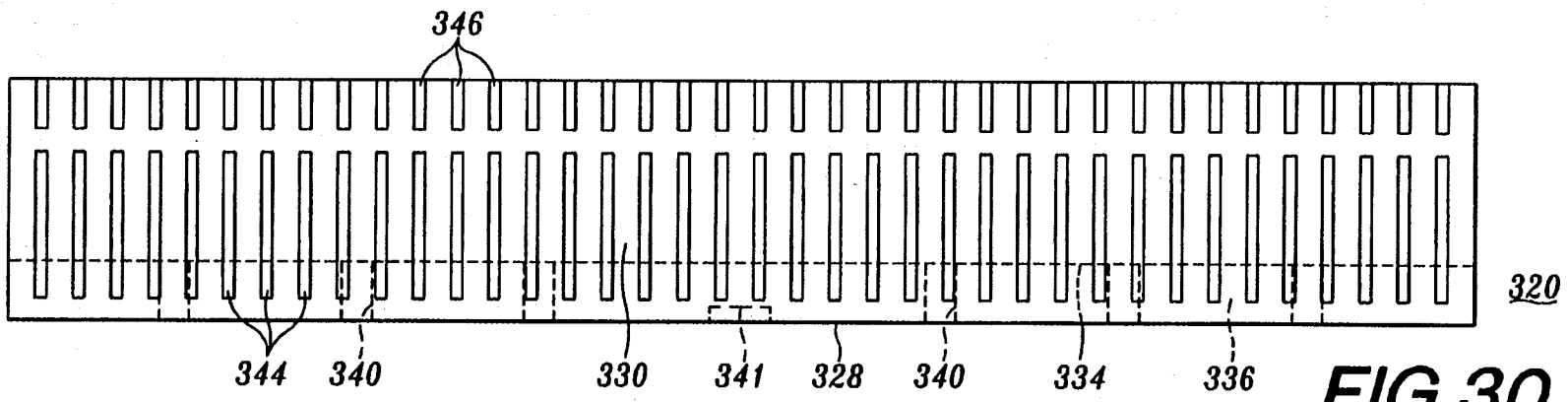
FIG. 30 shows a top view of the lagging member of FIG. 29.
Figure 31:
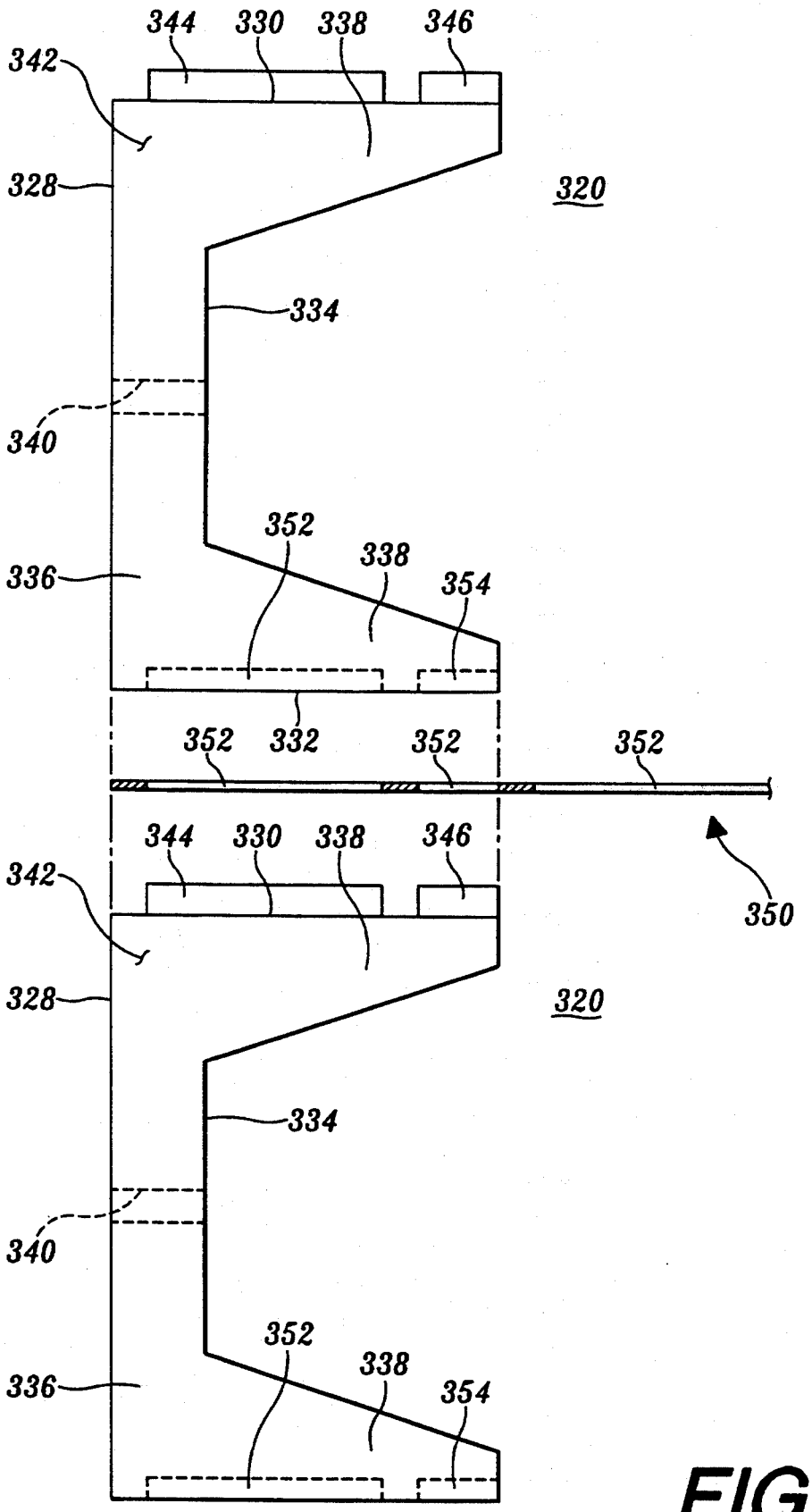
FIG. 31 shows an exploded end view of two lagging members of FIG. 29 configured for interlocking assembly with the edge portion of a section of soil-grid.

In accordance with the present invention, hollow polymeric lagging members can be substituted for the cast in place concrete to surface the embankment and firmly anchor the facing to the soil-grid. Such a lagging member 320 is shown in FIGS. 29 through 31. The lagging member 320 is formed from an elongate, polymeric shell 322 having a major wall 324 and first and second endwalls 326. As has been described with regard to previous embodiments, the shell 322 is preferably of a unitary construction, and is formed from a rotationally molded thermoplastic such as polyethylene.

Referring to FIG. 31, the lagging member 320 preferably has a generally "C"-shaped configuration. The major wall 324 defines a substantially flat front surface 328, and parallel top and bottom surfaces 330 and 332 respectively, projecting perpendicularly therefrom. The back surface 334 has a generally "C"-shaped profile. Thus, the lagging member 320 defines a central web section 336 and top and bottom flange sections 338 projecting substantially perpendicularly from the long edges of the central web section 336. The contour of the major wall 324 is designed for increased structural strength, and can be varied as needed in order to achieve the required strength for a particular application.

The major wall 324 further defines a plurality of horizontal internal passages 340 (FIGS. 29 and 31 ) that pass from the front surface 328 to the back surface 334. The internal passages 340 are located within the central web section 336 of the lagging member 320. Each internal passage 340 has a tubular wall, as previously described, and passes through the internal cavity 342 of the lagging member. The purpose of the horizontal internal passages 340 is to allow drainage of collected water from the soil retained by a wall constructed from the lagging members 320. The internal passages 340 can be sealed with plastic caps (not shown), if desired to prevent water drainage or weepage.

The lagging member 320 further includes a circular aperture 341 formed through the front face 328. The aperture 341 opens into the internal cavity 342, and is sized and contoured to receive the threaded end of a quick-disconnect coupling, such as a CAM-LOCK TM fitting. The coupling can be threaded into the aperture 341 either during or after installation, and serves as a connection to a grout hose terminating in a mating coupling, to facilitate post-installation filling of the interior cavity 342 with grout.

Still referring to FIGS. 29 through 31, the top surface 330 is formed to include a series of upwardly projecting, fin-like long teeth 344 and short teeth 346. Referring to FIG. 30, a first set of long teeth 346 are arranged in parallel succession along the length of the lagging member 320 adjacent the front surface 328. The teeth 344 are oriented parallel to each other and perpendicular to the longitudinal axis of the lagging member 320. Each tooth 344 has a generally rectangular shape, as viewed from above. A second set of short teeth 346 is also included on the top surface 330. One short tooth 346 is disposed adjacent the back surface 334 in alignment with a corresponding long tooth 344. Except for length, the short teeth 346 are contoured and arranged similarly to the long teeth 344.

A section of soil-grid 350 (shown in cross section in FIG. 31 ) defines a two-dimensional array of slots 352. The dimensions and pattern arrangement of the teeth 344 and 346 on the lagging member 320 substantially match the dimensions and pattern of the slots 352 in the soil-grid 350. Referring to FIG. 31, the bottom surface 332 of each lagging member 320 defines a plurality of long, slot-like recesses 352 and short, slot-like recesses 354 that are dimensioned and arranged correspondingly to the pattern of the long teeth 344 and short teeth 346 on the top surface 330 of the lagging member.

When assembling a soil retention wall using the lagging members 320, the long teeth 344 and short teeth 346 of a lower lagging member are received through the apertures 352 informed in the exposed edge portion of a section of soil-grid 350. After having passed through the slots 352, the teeth 344 and 346 are received within the corresponding recesses 352 and 354 of an upper lagging member 320 that is stacked on top of the lower lagging member 320. The soil-grid 350 is thus captivated between the upper and lower lagging members 320. Additional layers of lagging members 320 are then added, interspersed with the edge portions of successive sections of soil grid 350. Each lagging member 320 can be filled with concrete after placement, if desired, as previously described.

As will be apparent to those of skill in the art, the specific arrangement and number of teeth formed on the lagging members can be varied to match other slot configurations formed in soil-grid sheets. Additionally, the teeth could alternately be formed on the: bottom surfaces of lagging members constructed in accordance with the present invention, with the corresponding recesses then being formed on the top surfaces.

Figure 32:
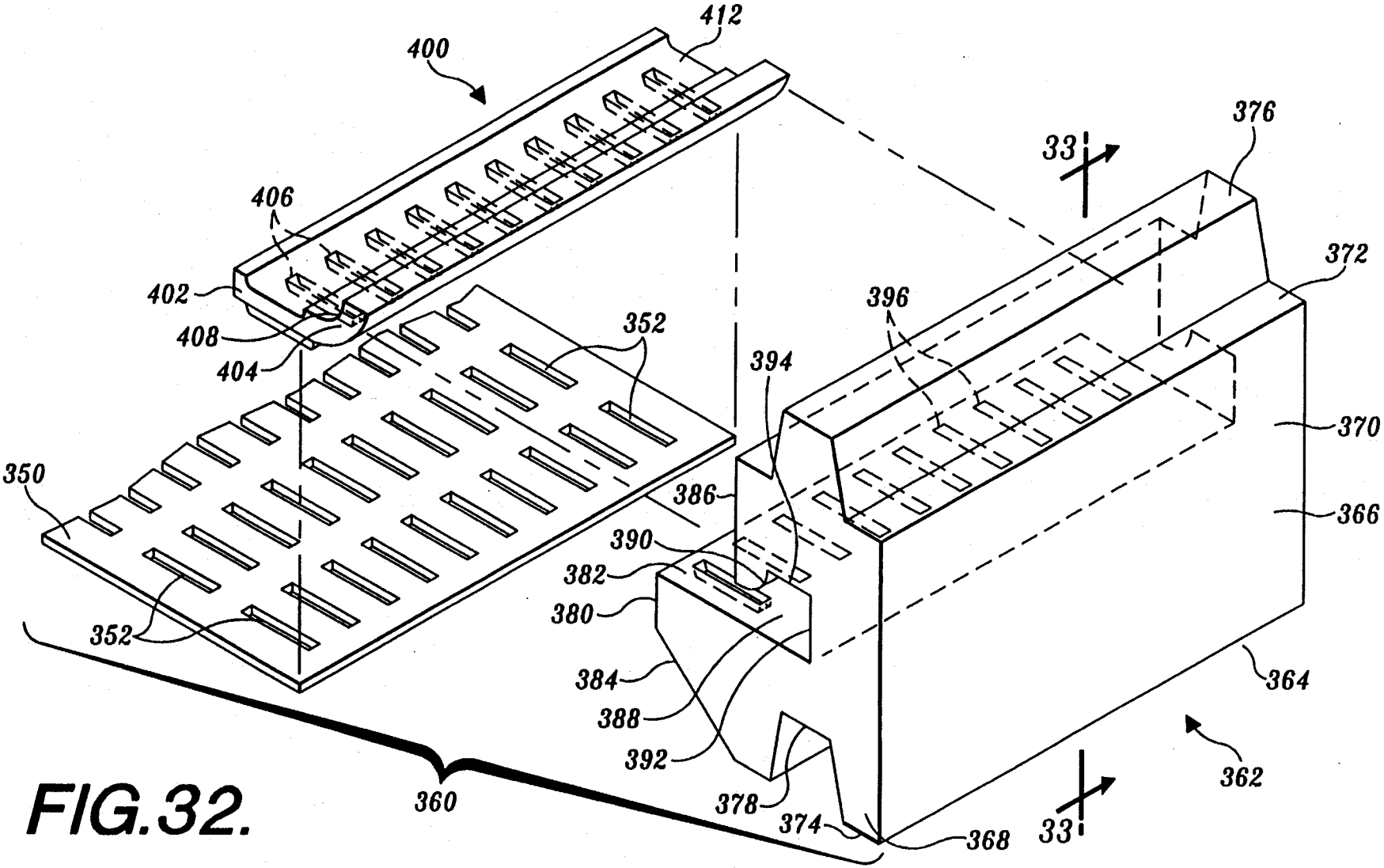
FIG. 32 shows an exploded pictorial view of an alternate lagging member and soil grid system including a mechanical locking element.
Figure 33:
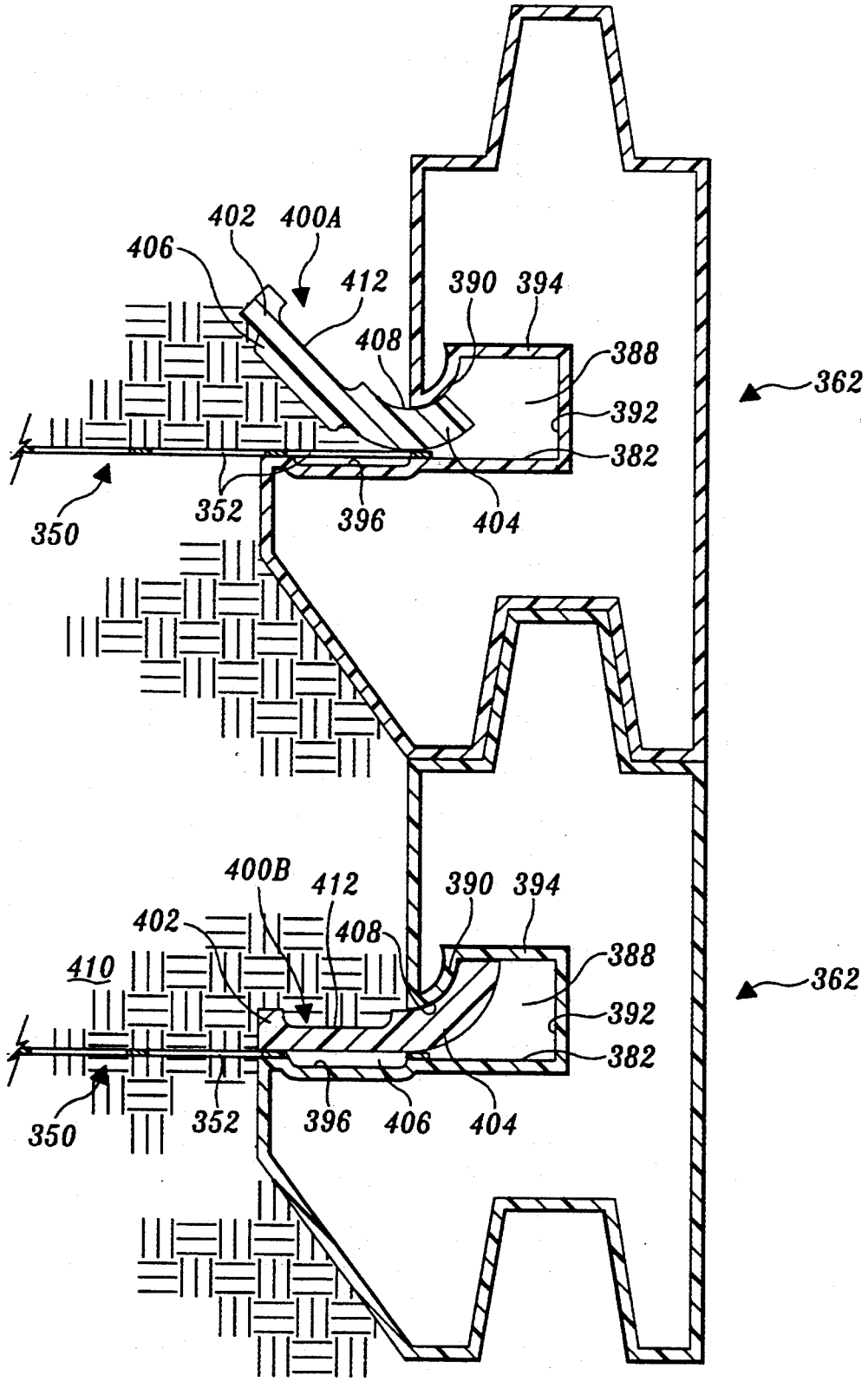
FIG. 33 shows a cross-sectional view of first and second stacked lagging members and soil-grid constructed as in FIG. 32, the cross-section being taken substantially along the line 33—33 of FIG. 32 for the first lagging member and along a corresponding line for the remaining members, with a first locking member shown installed and a second locking member shown in the process of being installed.

An alternate arrangement for lagging members constructed in accordance with the present invention for interfacing with sections of soil-grid 350 is shown in FIGS. 32 and 33. The illustrated lagging member and soil-grid retaining wall system 360 includes a plurality of hollow lagging members 362 that are stacked on top of each other to face an earthen bank reinforced with sections of soil grid 350. Each lagging member 362 is formed from a polymeric shell 364 including a major wall 366 and first and second (not shown) end walls 368.

The elongate major wall 366 defines a flat front surface 370 and parallel top and bottom surfaces 372 and 374, respectively, protecting rearwardly and perpendicularly therefrom. The top surface 372 is contoured to define an upwardly projecting, longitudinal engaging rib 376, while the bottom surface 374 defines a corresponding but inversely contoured engaging channel 378.

A back surface 380 of the member 362 is contoured to define a horizontal elongate shelf 382. Particularly, the back surface 380 includes an inclined section 384 that extends rearwardly and upwardly from the back edge of the bottom surface 374. The back surface 380 then extends upwardly a short distance, and back inwardly towards the front surface 370 to define the horizontal shelf 382. The back surface 380 further includes an upper section 386 that depends downwardly from the back edge of the top surface 372, terminating above and approximately centered over the shelf 382, to define a slot there between.

The slot between the lower terminus of the upper section 386 and the shelf 382 opens into a longitudinal channel 388. The lower terminus of the upper section 386 of the back surface 380 curves back upwardly and inwardly toward the upper surface 372, defining an elongate, arcuate camming surface 390. The channel 388 is defined by the shelf 382, a longitudinal vertical inner surface 392 projecting upwardly from the inner edge of the shelf 382, a longitudinal horizontal inner surface 394 extending from the upper edge of the vertical inner surface 392 to the upper edge of the arcuate camming surface 390, and the camming surface 390.

A plurality of elongate, slot-like engaging recesses 396 are defined by the shelf 382 outside of the channel 388. The slots 396 are oriented perpendicular to a longitudinal axis of the lagging member 362, and have sufficient length and are spaced apart to correspond to the pattern of the holes 352 defined in the soil-grid 350.

As shown in FIG. 33, when the lagging members 362 are used to face an earthen bank that has been reinforced with sections of soil-grid 350, the outer edge portion of each soil-grid section 350 overlies the shelf 382 of a corresponding lagging member 362. As so installed, the apertures 352 in each soil-grid 350 are aligned with corresponding recesses 396 formed in the shelf 382 of the corresponding lagging member 362.

Referring to both FIGS. 32 and 33, the system 360 further includes a plurality of elongate locking members 400. Each locking member 400 is approximately the same length as a lagging member 362. Each locking member 400 has a generally "j"-shaped cross section. The locking members 400 are preferably formed from a solid molding of a plastic material, such as high density polyethylene. Each locking member has a generally flat, elongate handle portion 402 that curves upwardly along one edge to define an arcuate camming portion 404.

A plurality of downwardly projecting fin-like engaging teeth 406 are formed on the underside of the handle portion 402 of each locking member 400. The teeth 402 are arranged in a spaced sequence, with each tooth being sized and arranged corresponding to the apertures 352 in the soil-grid sections 350 and the recesses 396 in the lagging members 362. Thus, each tooth is longer than it is wide, with the longitudinal axis of each tooth 406 being oriented perpendicular to the longitudinal axis of the locking member 400.

The upper surface of the curved camming portion 404 of each locking member 400 defines an elongate arcuate camming surface 408. Referring to FIG. 33, the locking members 400 are engaged with corresponding lagging members 362 to interconnect the soil-grid sections 350 to corresponding lagging members 362. To install a locking member, the arcuate camming portion 404 is inserted between the shelf 382 and the camming surface 390 of the corresponding lagging member 362. As noted above, the soil-grid 350 has previously been placed to overlap the shelf 382 of the lagging member. The locking member 400 is then caused to pivot, by depression of the handle portion 406, from this insertion position (illustrated by locking member 400A in FIG. 33), to an installed, locked position (illustrated by locking member 400B in FIG. 33).

During installation, the camming surface 408 of the locking member 400 slides over and engages with the camming surface 390 of the lagging member 362. When the locking member 400 is fully installed, the bottom surface of the handle portion 402 of the locking member 400 rests on the shelf 382 of the lagging member, which serves as a cooperative locking surface. In this fully installed position, the teeth 406 of the locking member 400 have passed through the apertures 352 of the soil-grid 350 and are received within the corresponding slots 396 of the lagging member 362. The engagement of the teeth 406 of the locking member 400 through the apertures 352 in the soil-grid 350 connects the soil-grid 350 to the lagging member 362. Soil 410 is then filled behind the lagging member 362, covering the upper surface of the handle portion 402 of the locking member 400A. The weight of the soil 410 bearing down on the handle portion 402 of the locking member 400 prevents the locking member 400 from pivoting upwardly out of this fully installed, locked position. To further facilitate this locking effect, a longitudinal trough 412 is preferably formed in the upper surface of the handle portion 402 of the locking member 400. This trough 412 is filled by soil 410 when the wall is backfilled after installation of each course of lagging members 362.

Soil retention walls can thus be constructed from lagging members 362 and locking members 400, with the lagging members 362 being securely connected to the soil-grid sections 350. The weight of the soil keeps the locking members 400 in the locked configuration, and renders a very stable wall. Even if a top layer of lagging members 362 is somehow knocked down, such as by impact with a moving vehicle, the earth retained behind the remaining lagging members 362 secures each of the remaining locking members 400, and thus lagging members 362, in place. It should also be apparent that in constructing a wall using the lagging members 362, the locking members 400 can be staggered longitudinally relative to the lagging members 362. Thus, each locking member 400 would be installed to interconnect and lock with a portion of each of two adjacent lagging members 362. In this fashion, the lagging members 362 are interconnected longitudinally.

The soil-grid retaining wall system 360 has been described above and illustrated in FIGS. 32 and 33 as preferably including engaging teeth and recesses formed on the locking members and lagging members, respectively. However, it should be apparent to those of skill in the art that the teeth and recesses could instead be formed on the lagging members and locking members, respectively. Further, it should also be apparent that the lagging members and locking members could alternately be formed with smooth or textured cooperating locking surfaces that do not include engaging recesses and teeth. In such instances, the soil-grid would be retained between the locking member and lagging member by friction and the compressive forces exerted by the locking member, i.e. the cam, on the soil-grid, due to the weight of the overlying soil.

While the preferred embodiment of the invention has been illustrated and described, it will be appreciated that various changes can be made therein without departing from the spirit and scope of the invention. It is therefore intended that the scope of letters patent granted hereon be limited only by the definitions of the appended claims.

The embodiments of the invention in which an exclusive property or privilege is claimed are defined as follows:

1. A soil retention wall system, comprising:

a plurality of piles emplaceable in spaced succession;

a plurality of hollow polymeric lagging members each defining an internal cavity, each lagging member having a major wall, wherein the major wall of at least one lagging member is contoured to define an internal passage extending from a first exterior surface of the major wall, through the interior of the lagging member, to a second exterior surface of the major wall, such that there is a path of fluid communication formed through the lagging member, but wherein the internal passage is sealed from fluid communication with the internal cavity and first and second endwalls each adapted to be engagable with a pile when the lagging members are stacked transversely relative to, and spanning between, successive piles, thereby forming a soil retention wall; and a non-fluid stress distributing media substantially filling the internal cavities of the lagging members.

2. The soil retention wall system of claim 1, wherein the major wall of each lagging member defines opposing first and second stacking surfaces and an internal passage extending from the first stacking surface of the major wall to the second stacking surface of the major wall, the internal passages of adjacent lagging members aligning when the lagging members are stacked transversely relative to the piles with a second stacking surface of an upper lagging member bearing upon the first stacking surface of a lower lagging member.

3. The soil retention wall system of claim 2, wherein each internal passage defines at least one aperture opening into the interior of the lagging member, forming a path of fluid communication from the aperture to the internal cavity.

4. A soil retention wall system comprising:

a plurality of piles emplaceable in spaced succession;

a plurality of hollow polymeric lagging members each defining an internal cavity, each lagging member having a major wall and first and second endwalls each adapted to be engagable with a pile when the lagging members are stacked transversely relative to, and spanning between, successive piles, thereby forming a soil retention wall; and a non-fluid stress distributing media substantially filling the internal cavities of the lagging members;

at least one anchor member embedable within the soil behind the soil retention wall; and connecting means for connecting the anchor to a corresponding lagging member, wherein the major wall of the corresponding lagging member is contoured to define an internal passage extending from a front surface of the lagging member to a back surface of the lagging member, passing through the interior of the lagging member therebetween, the connecting means being insertable through the internal passage and securable to the front surface of the lagging member;

a connecting plate positionable to cover the opening of the internal passage on the front surface of the lagging member, the connecting means being securable to the connecting plate to thereby prevent withdrawal of the connecting means through the lagging member;

a plurality of reinforcing members insertable longitudinally through the interior of the lagging member and extending from the first endwall of the lagging member to the second endwall of the lagging member, passing proximate the connecting plate therebetween; and a rigid, cementious material filling the interior of the lagging member and substantially encapsulating the reinforcing members, whereby the reinforcing members convey soil loads from the anchor to the piles when the wall system is assembled.

5. A lagging member for soil retention, comprising:

a hollow polymeric member formed from a one-piece shell including a major wall defining first and second stacking surfaces and first and second integral endwalls, the major wall and endwalls defining and enclosing a cavity therein, the lagging member having a base and a top, wherein the base is substantially the same width as the top and, wherein the major wall of the shell is contoured to define an internal passage extending from a first exterior surface of the major wall, through the cavity, and to a second exterior surface of the major walk such that there is a path of fluid communication formed through the lagging member, wherein the internal passage is sealed from fluid communication with the cavity.

6. A lagging member for soil retention, comprising:

a hollow polymeric member formed from a one-piece shell including a major wall defining opposing first and second stacking surfaces and first and second integral endwalls, the major wall and endwalls defining and enclosing a cavity therein, the lagging member having a base and a top, wherein:

the base is substantially the same width as the top;

the first endwall of the shell is contoured to define an interlocking channel, defining at least one corresponding but inversely contoured transverse recess;

the second endwall of the shell is contoured to define an inversely contoured interlocking rib defining at least one transverse projection;

one of the first and second stacking surfaces of the major wall defines an elongate engaging channel and the other one of the first and second stacking surfaces defines an inversely contoured elongate engaging rib;

the major wall of the shell is contoured to define at least one internal passage extending from the first stacking surface of the lagging member to the second stacking surface of the lagging member, passing through the internal cavity therebetween, further comprising at least one reinforcing member insertable into the internal passage.

7. A lagging member for soil retention, comprising:

a hollow polymeric member formed from a one-piece shell including a major wall defining first and second stacking surfaces and first and second integral endwalls, the major wall and endwalls defining and enclosing a cavity therein, the lagging member having a base and a top, wherein the base is substantially the same width as the top, wherein the major wall defines opposing first and second stacking surfaces and one of the first and second stacking surfaces of the major wall defines a plurality of outwardly projecting engaging teeth arranged in a pattern corresponding to a pattern of apertures formed in a section of soil-grid, and the other of the first and second stacking surfaces defines a plurality of inversely contoured and correspondingly arranged engaging recesses.

8. A soil retention wall system, comprising:

at least one section of soil-grid embedable in a soil bank and having an edge portion protruding outwardly therefrom, the soil-grid defining a plurality of apertures arranged in a pattern;

a plurality of elongate polymeric lagging members, having first and second elongate stacking surfaces, stackable to form a wall facing the soil bank; and connecting means, including a plurality of engaging recesses, formed in a locking surface of at least one lagging member, for connecting the edge portion of the soil-grid to at least one of the lagging members, wherein the locking surface of each lagging member comprises one of the first and second stacking surfaces and the other of the first and second stacking surfaces defines a plurality of engaging teeth arranged in a pattern corresponding to the pattern of apertures in the soil-grid, whereby the lagging members are stackable with the edge portion of the soil-grid being received between the first stacking surface of a lower lagging member and the second stacking surface of an upper lagging member, with the engaging teeth of one of the lower and upper lagging members passing through the apertures of the edge portion of the soil-grid and being received by the engaging recesses of the other or the lower and upper lagging members.

9. The soil retention wall system of claim 8; wherein each lagging member includes an elongate center web section defining upper and lower long edges, and elongate parallel upper and lower flange sections projecting substantially perpendicularly from the upper and lower edges of the center web section, respectively, the upper and lower flange sections defining the first and second stacking surfaces, respectively.

10. A soil retention wall system, comprising:

at least one section of soil-grid embedable in a soil bank and having an edge portion protruding outwardly therefrom, the soil-grid defining a plurality of apertures arranged in a pattern;

a plurality of elongate polymeric lagging members, having first and second elongate stacking surfaces, stackable to form a wall facing the soil bank; and connecting means, including a plurality of engaging recesses, formed in a locking surface of at least one lagging member, for connecting the edge portion of the soil-grid to at least one of the lagging members, wherein the connecting means further includes at least one elongate locking member engagable with the locking surface of a lagging member to connect the soil-grid section to the lagging member, the locking member including a plurality of engaging teeth arranged in a pattern corresponding to the pattern of apertures in the soil-grid section, whereby the locking member and the lagging member are engagable with the edge portion of the soil-grid being received between the engaged locking member and the locking surface of the lagging member, with the engaging teeth passing through the apertures of the edge portion of the soil-grid and being received by the engaging recesses.

11. The soil retention wall system of claim 10, wherein:

the major wall of the lagging member is contoured to define a longitudinal channel adjacent the locking surface of the lagging member, the longitudinal channel defining a longitudinal, arcuate camming surface; and the locking member includes a longitudinal locking portion defining a corresponding camming surface, the locking portion of the locking member being insertable within the longitudinal channel of the lagging member when the locking member is engaged with the lagging member, with the camming surface of the locking member sliding over the camming surface of the longitudinal channel.

* * * * *